US009134673B2

(12) United States Patent
Iida et al.

(10) Patent No.: US 9,134,673 B2
(45) Date of Patent: Sep. 15, 2015

(54) IMAGE FORMING APPARATUS, IMAGE INFORMATION GENERATION METHOD, AND COMPUTER PROGRAM

(75) Inventors: Ken-ichi Iida, Tokyo (JP); Hideo Nanataki, Yokohama (JP); Keisuke Mitsuhashi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 423 days.

(21) Appl. No.: 12/993,895

(22) PCT Filed: Aug. 7, 2009

(86) PCT No.: PCT/JP2009/064326

§ 371 (c)(1),
(2), (4) Date: Nov. 22, 2010

(87) PCT Pub. No.: WO2010/016623

PCT Pub. Date: Feb. 11, 2010

(65) Prior Publication Data

US 2011/0135332 A1 Jun. 9, 2011

(30) Foreign Application Priority Data

Aug. 8, 2008 (JP) ..... 2008-206071

(51) Int. Cl.
*G03G 15/01* (2006.01)
*G03G 15/00* (2006.01)

(52) U.S. Cl.
CPC .. *G03G 15/5095* (2013.01); *G03G 2215/00594* (2013.01)

(58) Field of Classification Search
USPC ..... 399/53, 66
See application file for complete search history.

(56) References Cited

U.S. PATENT DOCUMENTS

| | | | | |
|---|---|---|---|---|
| 6,505,016 | B2 | 1/2003 | Tomita | |
| 2001/0051057 | A1 | 12/2001 | Tomita | |
| 2005/0180767 | A1 * | 8/2005 | Ishii et al. | 399/66 |
| 2007/0019220 | A1 | 1/2007 | Miyazaki et al. | |
| 2009/0136247 | A1 | 5/2009 | Nada et al. | |

FOREIGN PATENT DOCUMENTS

| | | | |
|---|---|---|---|
| CN | 1320843 | A | 11/2001 |
| EP | 0 905 647 | A2 | 3/1999 |
| EP | 1 739 505 | A1 | 1/2007 |
| JP | 10-337886 | A | 12/1998 |
| JP | 2001235973 | A * | 8/2001 |
| JP | 2005-91767 | A | 4/2005 |

(Continued)

OTHER PUBLICATIONS

Notice of Preliminary Rejection dated May 23, 2012, in Korean Application No. 10-2011-7004472.
Notification Concerning Transmittal of International Preliminary Report on Patentability mailed Feb. 17, 2011, in counterpart International Application No. PCT/JP2009/064326.

(Continued)

*Primary Examiner* — Quana M Grainger
(74) *Attorney, Agent, or Firm* — Fitzpatrick, Cella, Harper & Scinto

(57) ABSTRACT

When a toner image including an edge area (Ae) corresponding to an area defined between edges of a transfer material (P), and an internal area (Ai) corresponding to an area inside the edge area (Ae) is formed on an image bearing member (11), the toner image in the edge area is subjected to toner amount increment processing of incrementing a toner amount.

19 Claims, 14 Drawing Sheets

(56) References Cited

FOREIGN PATENT DOCUMENTS

| | | | | |
|---|---|---|---|---|
| JP | 2006-145605 | A | | 6/2006 |
| JP | 2006-221006 | A | | 8/2006 |
| JP | 2007-30192 | A | | 2/2007 |
| JP | 2007-65423 | A | | 3/2007 |
| JP | 2008-122512 | A | | 5/2008 |
| JP | 2008170765 | A | * | 7/2008 |
| JP | 2009128757 | A | * | 6/2009 |
| JP | 2009171439 | A | * | 7/2009 |
| JP | 2009265404 | A | * | 11/2009 |

OTHER PUBLICATIONS

International Preliminary Report on Patentability dated Feb. 8, 2011, in counterpart International Application No. PCT/JP2009/064326.

Written Opinion of the International Searching Authority, dated Jun. 9, 2009, in counterpart International Application No. PCT/JP2009/064326.

Notification of the First Office Action dated Mar. 18, 2013, in Chinese Application No. 200980130415.8.

European Search Report received Jul. 12, 2013, in related European Patent Application No. 09805100.6.

* cited by examiner

FIG. 14

| | | | DATA [%] | | | | | PRINT IMAGE LEVEL | |
|---|---|---|---|---|---|---|---|---|---|
| TEST | PRESENCE OF PROCESSING S804 | COLOR # | Y | M | C | K | SUM | TONER SMEAR OF TRANSFER MATERIAL BY OFFSET | IMAGE QUALITY BY THE DIFFERENCE OF CHROMATICITY BETWEEN Ae AREA AND Ai AREA |
| No.1 (PRESENT EMBODIMENT) | PRESENCE | 1 | 10 | 8 | 15 | 60 | 93 | NOT OCCUR | NO PROBLEM LEVEL |
| | | 2 | 20 | 17 | 30 | 80 | 147 | NOT OCCUR | NO PROBLEM LEVEL |
| | | 3 | 30 | 25 | 45 | 100 | 200 | NOT OCCUR | NO PROBLEM LEVEL |
| | | 4 | 13 | 60 | 0 | 0 | 73 | NOT OCCUR | SUBSTANTIALLY NO PROBLEM LEVEL |
| | | 5 | 27 | 80 | 0 | 0 | 107 | NOT OCCUR | SUBSTANTIALLY NO PROBLEM LEVEL |
| | | 6 | 40 | 100 | 0 | 0 | 140 | NOT OCCUR | SUBSTANTIALLY NO PROBLEM LEVEL |
| | | 7 | 57 | 40 | 0 | 0 | 97 | NOT OCCUR | SUBSTANTIALLY NO PROBLEM LEVEL |
| | | 8 | 83 | 60 | 0 | 0 | 143 | NOT OCCUR | SUBSTANTIALLY NO PROBLEM LEVEL |
| | | 9 | 93 | 80 | 0 | 0 | 173 | NOT OCCUR | SUBSTANTIALLY NO PROBLEM LEVEL |
| No.2 (COMPARATIVE EXAMPLE) | NON PRESENCE | 1 | 0 | 0 | 0 | 60 | 60 | OCCUR | |
| | | 2 | 0 | 0 | 0 | 80 | 80 | OCCUR | |
| | | 3 | 0 | 0 | 0 | 100 | 100 | OCCUR | |
| | | 4 | 0 | 60 | 0 | 0 | 60 | SLIGHTLY OCCUR | |
| | | 5 | 0 | 80 | 0 | 0 | 80 | SLIGHTLY OCCUR | |
| | | 6 | 0 | 100 | 0 | 0 | 100 | SLIGHTLY OCCUR | |
| | | 7 | 40 | 40 | 0 | 0 | 80 | SLIGHTLY OCCUR | |
| | | 8 | 60 | 60 | 0 | 0 | 120 | SLIGHTLY OCCUR | |
| | | 9 | 80 | 80 | 0 | 0 | 160 | SLIGHTLY OCCUR | |

FIG. 18

| LENGTH OF X [mm] | PRINT IMAGE LEVEL | |
|---|---|---|
| | IMAGE QUALITY BY THE DIFFERENCE OF CHROMATICITY BETWEEN Ae AREA AND Ai AREA | TONER SMEAR OF TRANSFER MATERIAL BY OFFSET |
| $0 \leqq X < 1$ | LOW | OCCUR |
| $1 \leqq X \leqq 3$ | LOW | NOT OCCUR |
| $3 < X \leqq 5$ | A LITTLE HIGH BUT NO-PROBLEM | NOT OCCUR |
| $X > 5$ | HIGH | NOT OCCUR |

IMAGE FORMING APPARATUS, IMAGE INFORMATION GENERATION METHOD, AND COMPUTER PROGRAM

TECHNICAL FIELD

The present invention relates to an image forming apparatus such as a copying machine or a printer that transfers a toner image formed on an image bearing member by electrophotographic process to a transfer material, and then fixes the toner image to obtain a fixed image on the transfer material, an image information generation method, and a computer program.

BACKGROUND ART

An electrophotographic image forming apparatus that includes a process of transferring a toner image formed on a surface of an image bearing member to a transfer material such as paper has been well-known. A color image forming apparatus generally employs a configuration in which multiple photosensitive members are lined up, toner images are sequentially formed by the respective photosensitive members, and the toner images are transferred to a transfer material directly or via an intermediate transfer member.

Recent diversification of printer demands has been accompanied by a rise in request for no-margin print in the color image forming apparatus in particular. There has conventionally been known a method, in which a transfer material slightly larger than an image is used and margins thereof after printing are cut. To simplify the cutting work, the necessity of so-called no-margin print of printing an image on an entire surface of the transfer material without forming any margins on the edges of the transfer material beforehand has increased.

For an ink-jet image forming apparatus, an apparatus with a no-margin print function has been brought to the market. For example, Japanese Patent Application Laid-Open No. H10-337886 discloses the technology.

In an attempt to realize an electrophotographic full-color image forming apparatus that supports no-margin print, there arise the following technical problems.

During an image forming operation, on the transfer material after a toner image transfer process, toner may be transferred not only to the surface of the transfer material but also to at least one of edge surfaces of the transfer material located at four sides surrounding the transfer material.

In this case, when the transfer material enters a fixing device, the toner of the edge portions of the transfer material may not be fixed to paper at a fixing nip to cause a fixing failure. As a result, an offset phenomenon occurs on surfaces of a fixing film and a pressure roller. In the case where this offset occurs, when the offset toner is adhered again to the top surface or the back surface of the transfer material, a toner smear occurs in the transfer material, resulting in an image failure.

DISCLOSURE OF THE INVENTION

A purpose of the present invention is to improve the fixing performance during no-margin print.

Another purpose of the invention is to provide an image forming apparatus, including an image forming section that forms a no-margin image by forming, on an image bearing member, a toner image of an edge area defined with an inside width inward and an outside width outward defined from edges of a transfer material, performing transfer of the toner image formed on the image bearing member onto the transfer material, and inserting the transfer material in which the transfer is performed into a fixing device; and a processing section that performs toner amount increment processing for incrementing a toner amount, wherein the toner image of the edge area formed on the image bearing member is subjected to the toner amount increment processing, by the processing section, the toner amount; and the image forming section forms the toner image subjected to the toner amount increment processing on the image bearing member.

A further purpose of the invention is to provide an image information generation method including generating, in an image forming apparatus, image information for forming a no-margin image by forming, on an image bearing member, a toner image of an edge area defined with an inside width inward and an outside width outward defined from edges of a transfer material, performing transfer of the toner image formed on the image bearing member onto the transfer material, and inserting the transfer material in which the transfer is performed into a fixing device; and performing, for image information of the toner image of the edge area, toner amount increment processing for incrementing a toner amount of the toner image formed on the image bearing member.

A still further purpose of the invention is to provide a computer program, which controls a computer to execute processing of generating, in an image forming apparatus, image information for forming a no-margin image by forming, on an image bearing member, a toner image of an edge area defined with an inside width inward and an outside width outward defined from edges of a transfer material, performing transfer of the toner image formed on the image bearing member onto the transfer material, and inserting the transfer material in which the transfer is performed into a fixing device; and processing of performing, for image information of the toner image of the edge area, toner amount increment processing of incrementing a toner amount of the toner image formed on the image bearing member.

Further features of the present invention will become apparent from the following description of exemplary embodiments with reference to the attached drawings.

BRIEF DESCRIPTION OF THE DRAWINGS

FIGS. 4A and 4B illustrate a relationship between an image size and a transfer material size in the image forming apparatus according to the first embodiment, in which FIG. 4A illustrates a transfer material when there is a margin, and FIG. 4B illustrates a transfer material when there is no margin;

FIG. 14 illustrates comparison test results according to the first embodiment;

FIG. 18 illustrates comparison test results according to the third embodiment.

BEST MODES FOR CARRYING OUT THE INVENTION

Figure 1:
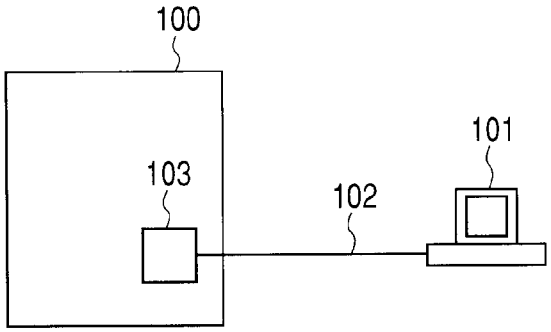
FIG. 1 illustrates an image forming system according to a first embodiment.

Preferred embodiments of the present invention will now be illustrated. The individual embodiments described below will be helpful in understanding a variety of concepts of the present invention from the generic to the more specific. Further, the technical scope of the present invention is defined by the claims, and is not limited by the following individual embodiments.

First Embodiment

Referring to the drawings, an image forming apparatus according to the present invention is described in detail.

Image Forming System Diagram

FIG. 1 illustrates an image forming system in which an image forming apparatus and an image transmission apparatus are interconnected.

As illustrated in FIG. 1, an image forming apparatus 100 of the present embodiment is connected to a personal computer 101 that is the image transmission apparatus via a cable 102. Image information is transmitted from the personal computer 101 to a controller 103 via the cable 102, and then subjected to image data processing described later to be transmitted to a printer engine control unit 104.

The image forming apparatus 100 has a function of forming images in a no-margin print mode that is a first image forming mode for performing no-margin print on a transfer material P and in a margin print mode that is a second image forming mode for performing normal margin print on the transfer material P. The no-margin print is called no-edge print, which implies an image forming method of forming an image in the entire area of the transfer material. Hereinafter, the image forming mode for forming an image in the entire area of the transfer material is referred to as a no-margin print mode. An image forming mode for forming an image in an area excluding a predetermined area of four sides surrounding the transfer material is referred to as a margin print mode.

Configuration Diagram of Image Forming Apparatus

Figure 2:
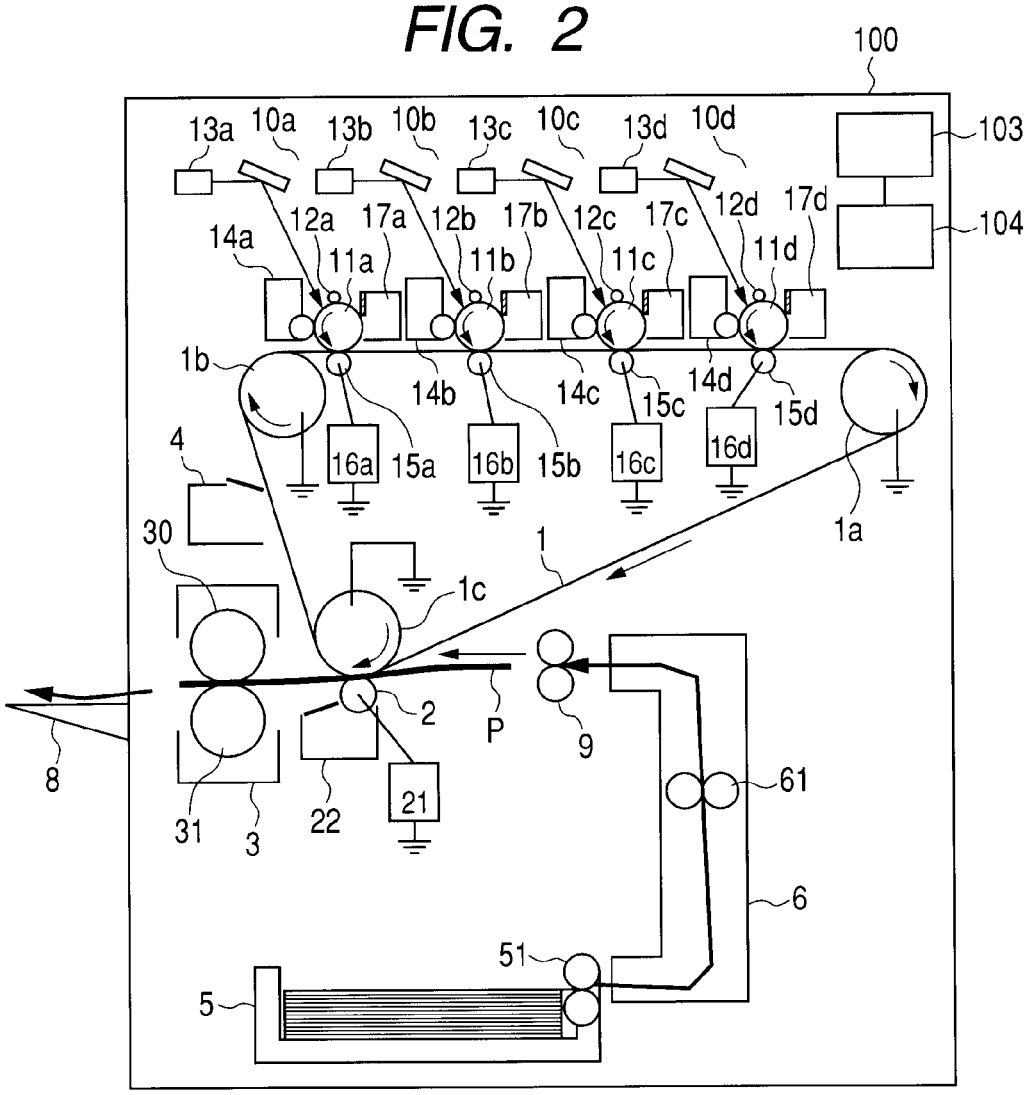
FIG. 2 illustrates a configuration of an image forming apparatus according to the first embodiment.

FIG. 2 is a sectional view illustrating the image forming apparatus 100 of the first embodiment. As illustrated in FIG. 2, the image forming apparatus of the present embodiment is described by using a full-color printer having four drums and employing an intermediate transfer method. The image forming apparatus includes four-color image forming sections (image forming stations 10) 10*a* to 10*d* of yellow (Y), magenta (M), cyan (C), and black (K), a transfer device that includes an intermediate transfer belt 1 as an intermediate transfer member, and a fixing device 3. However, the present invention is not necessarily limited to the four-color image forming apparatus. For example, the present invention can be applied to a six-color image forming apparatus that additionally includes light cyan and light magenta.

The image forming stations 10*a* to 10*d* are formed into image forming units, and photosensitive members (drum electrophotographic photosensitive members) 11*a* to 11*d* serving as image bearing members are provided so as to freely rotate in arrow directions. On the outer peripheral surfaces of the photosensitive members 11*a* to 11*d*, primary charging rollers 12*a* to 12*d* are disposed to uniformly charge the surfaces of the photosensitive members. On the downstream side of the photosensitive member rotation direction of the primary charging rollers 12, laser exposure devices 13*a* to 13*d* are disposed to expose the surfaces of the photosensitive members by emitting (casting) laser beams modulated corresponding to image information to the surfaces of the photosensitive members. On the downstream side of the laser exposure devices 13, developing devices 14*a* to 14*d* are disposed to develop electrostatic latent images of respective colors formed on the surfaces of the photosensitive members by laser exposure by using toner of corresponding colors of yellow, magenta, cyan and black.

The primary transfer rollers 15*a* to 15*d* forming primary transfer parts with the photosensitive members are provided so as to face to the photosensitive members 11*a* to 11*d* to pinch an intermediate transfer belt 1 at each of the positions (transfer positions) in which the intermediate transfer belt 1 is pinched by the photosensitive members 11*a* to 11*d* and the primary transfer rollers 15*a* to 15*d*. Primary transfer power sources 16*a* to 16*d* are connected to the primary transfer rollers 15*a* to 15*d*, and variable primary transfer voltages Vy, Vm, Vc and Vk are applied thereto.

The intermediate transfer belt 1 is hung on three rollers such as a drive roller 1*a*, a tension roller 1*b* and a secondary transfer opposed roller 1*c*, and vertically put through the image forming stations 10*a* to 10*d* to be brought into contact with the photosensitive members 11*a* to 11*d*. The intermediate transfer belt 1 is rotatably driven in the arrow direction of FIG. 2 by the drive roller 1*a*. Drum cleaners 17*a* to 17*d* are installed on the downstream side of the primary transfer rollers 15*a* to 15*d* of the photosensitive members 11*a* to 11*d*. A belt cleaner 4 is disposed on a surface of the intermediate transfer belt 1.

The printer engine control unit 104 controls each part of a printer engine according to image information or various instructions received from the controller 103. The printer engine substantially refers to parts that perform operations regarding image formation excluding the controller 103 and the printer engine control unit 104 in the image forming apparatus 100 of FIG. 2.

An image forming operation of the image forming apparatus thus configured is described below by taking an example of the yellow image forming station 10*a*. The photosensitive member 11*a* of the yellow image forming station 10*a* includes a photoconductive layer formed on an aluminum cylindrical surface, and its surface is uniformly charged to be minus, which is −600V as the charge potential, by the primary charging roller 12*a* during the rotation in the arrow direction.

Subsequently, image information sent from the personal computer 101 is converted into laser emission intensity or time by image data processing described later, and the laser exposure device 13*a* executes image exposure. The surface potential after exposure is equal to −200V. As a result, an electrostatic latent image corresponding to a yellow image component of a previous image is formed on the surface of the photosensitive member 11*a*. This electrostatic latent image is developed by using yellow toner minus-charged by the developing device 14*a* to be made visible as a yellow toner image.

The obtained yellow toner image is primarily transferred to the intermediate transfer belt 1 by applying a primary transfer voltage to the primary transfer roller 15*a* from the primary transfer power source 16*a*. The photosensitive member 11*a* after the transfer is put to use for next image formation by removing transfer residual toner adhered to the surface thereof by the drum cleaner 17*a*.

Such image forming operations are carried out at the image forming stations 10*a* to 10*d* at predetermined timings, and toner images on the photosensitive members 11*a* to 11*d* are sequentially stacked on the intermediate transfer belt 1 to be primarily transferred by the primary transfer parts. In a full-color mode, toner images are sequentially transferred to the intermediate transfer belt 1 in an order of yellow, magenta, cyan and black. In a monochrome mode, black toner images are transferred in the same order as that of the above. Then, following rotation of the intermediate transfer belt 1 in the arrow direction, the four-color toner images on the intermediate transfer belt 1 are moved to a secondary transfer nip abutting the secondary transfer opposed roller 1*c* with which a secondary transfer roller 2 is grounded and pinching the intermediate transfer belt 1. A secondary transfer power source 21 applies a secondary transfer voltage to the secondary transfer roller 2 brought into contact with the transfer material P fed from feed rollers 9 at a predetermined timing. Thus, the toner images are secondarily transferred collectively to the transfer material P. Transfer residual toner adhered to the surface of the intermediate transfer belt 1 after the secondary transfer is removed by the belt cleaner 4, and the intermediate transfer belt 1 is put to use for next image formation.

The transfer material P, which has the unfixed toner image and has passed through the secondary transfer nip, is conveyed to the fixing device 3, and the unfixed toner image is heated and pressurized to become a fixed image. The transfer material P delivered from the fixing device 3 is delivered to a delivery tray 8 disposed outside the apparatus.

Transfer Material Cassette

Figure 3:
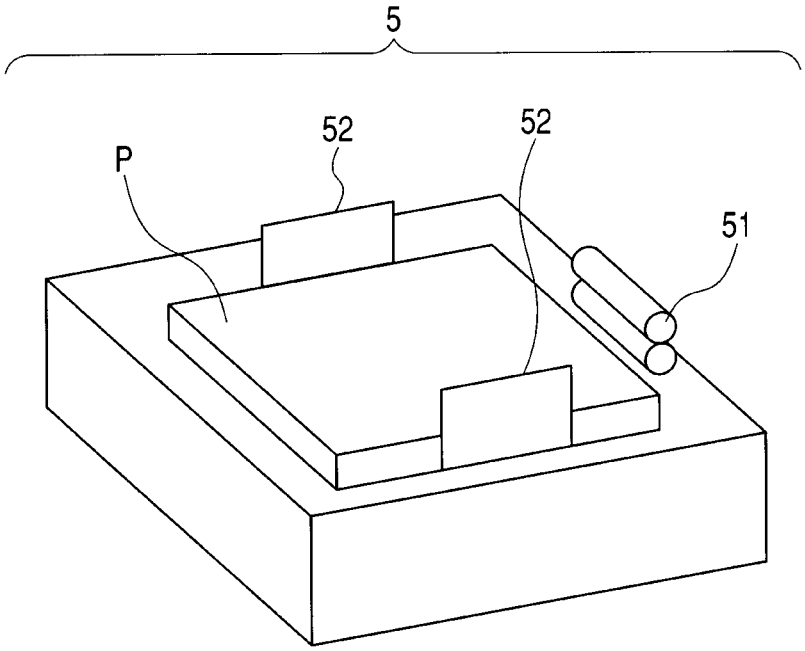
FIG. 3 illustrates a configuration of a transfer material cassette of the image forming apparatus according to the first embodiment.

Referring to FIG. 3, a transfer material cassette 5 is described. FIG. 3 is a perspective view of the transfer material cassette 5.

As illustrated in FIG. 3, a pair of longitudinal position regulation plates 52 within the transfer material cassette 5 aligns the transfer materials P so as to match its longitudinal center (center in a scanning direction) with a longitudinal center of each rotary member, and stores the transfer materials P. In this case, rotary members are the photosensitive members 11*a* to 11*d*, the intermediate transfer belt 1, a fixing film 30, and a pressure roller 31.

Thus, the transfer material P taken out from the transfer material cassette 5 is inserted into the secondary transfer nip and the fixing nip with its longitudinal center matching those of the photosensitive members 11*a* to 11*d*, the intermediate transfer belt 1, the fixing film 30 and the pressure roller 31. In other words, the image forming apparatus of the present embodiment has a so-called center reference configuration. The transfer material P taken out from the transfer material cassette 5 by a pickup roller pair 51 is inserted into the secondary transfer nip by convey rollers 61 of a paper feeder 6 and the feed rollers 9 at a predetermined timing synchronized with the toner image on the intermediate transfer belt 1.

Image Forming Areas in Margin Print Mode and No-Margin Print Mode

Figure 4A:
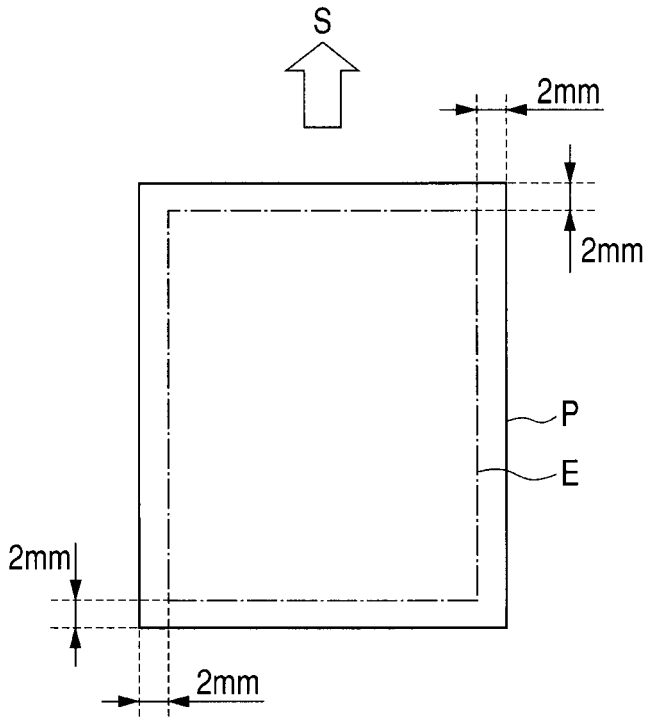
Figure 4B:
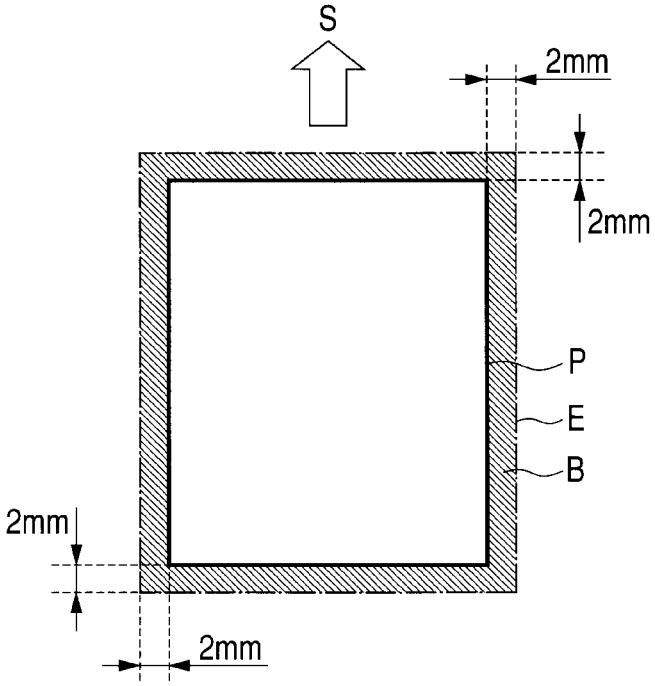

Referring to FIGS. 4A and 4B, image forming expanded areas for the transfer material P in the no-margin print mode are described. FIG. 4A illustrates a transfer material when there is a margin, and FIG. 4B illustrates a transfer material when there is no margin. In FIGS. 4A and 4B, the transfer materials are conveyed in transfer material conveying directions S.

In the image forming apparatus, when margin print is carried out on the transfer material P, a mask area E defining a printing area with respect to a size of the transfer material P is an area illustrated in FIG. 4A. In other words, the area is an area 2 mm inside from each of leading, trailing, left and right edges of the transfer material P. At timing inside the mask area E, each of the laser exposure devices 13 emits a laser beam based on image data so as to form an electrostatic latent image for developing the visible toner image on the photosensitive drum.

On the other hand, in the case of executing no-margin print on the transfer material P, the mask area E is expanded compared to the case where margin print is carried out, to thereby become an area illustrated in FIG. 4B. Specifically, the area is larger than the transfer material P by an amount equal to an image forming expanded area B having a width of 2 mm in each of the leading, trailing, left and right edges of the transfer material P.

In a contact of the secondary transfer part between the intermediate transfer belt 1 and the transfer material P, a moving speed difference is generated due to mechanical precision or transfer efficiency. For example, a moving speed of the transfer material P is higher than that of the intermediate transfer belt 1. In this case, a moving-direction length of an image after secondary transfer to the transfer material P is larger. Thus, in such a case, toner images (electrostatic latent images) are formed on the photosensitive members 11*a* to 11*d* so that an image forming expanded area having a width of 2 mm can be formed in each of the leading and trailing edges of the image forming expanded area B described above after secondary transfer.

Thus, an image including an image part of the image forming expanded area B is formed on the photosensitive member, primarily transferred to the intermediate transfer belt 1, and then secondarily transferred to the transfer material P. During the secondary transfer process, even if a positional relationship slightly shifts between the image on the intermediate transfer belt and the transfer material P, the image forming expanded area is provided, and hence a no-margin print image is obtained on the transfer material P without failure.

During secondary transfer, a part of the toner image in the image forming expanded area outside the transfer material P attaches to the secondary transfer roller 2. This toner is removed by a secondary transfer roller cleaner 22 abutting the secondary transfer roller 2.

In this way, a no-margin full-color image having four-color toner images transferred and fixed can be obtained on the transfer material P.

Offset

Figure 5:
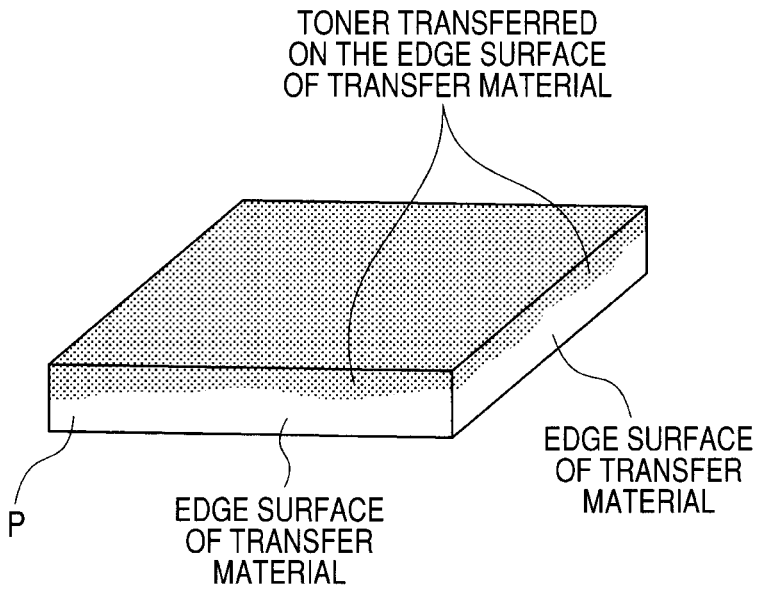
FIG. 5 is a perspective view illustrating a toner attachment status on an edge surface of a transfer material.

In the image forming apparatus, on the transfer material P after the secondary transfer process at the secondary transfer nip, toner is transferred not only to the surface but also the edge surface of the transfer material. FIG. 5 is a perspective view illustrating an attachment status of toner transferred to the edge surface of the transfer material. The "edge surface of the transfer material" implies a side surface of the transfer material as illustrated in FIG. 5.

Figure 6:
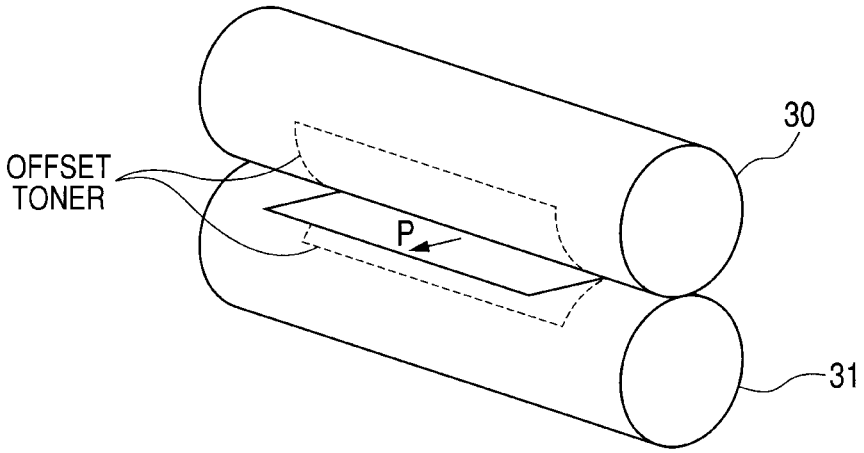
FIG. 6 is a perspective view illustrating a toner offset status.

When the transfer material P enters the fixing device 3, the toner on the edge surface of the transfer material is not sufficiently fixed to the transfer material P at the fixing nip, causing an offset phenomenon on surfaces of the fixing film 30 and the pressure roller 31. FIG. 6 illustrates an example of a toner offset status. This offset is a so-called hot offset phenomenon in which the toner image is excessively heated in the edge surface of the transfer material P, excessively melted, and not fixed on the transfer material P to be transferred to the fixing film and the pressure roller.

In the edge surface of the transfer material, as compared with a normal surface portion inside the transfer material, in particular, hot offset easily occurs for the following reason.

When the transfer material is inserted into the fixing nip formed by the fixing film 30 and the pressure roller 31, in a portion inside the transfer material, the transfer material surface is disposed in the entire region in the fixing nip, and the sufficient amount of heat necessary for securing fixing performance is uniformly applied. In the edge surface of the transfer material and its vicinity, however, a portion having a transfer material and a toner image and a portion having no transfer material and no toner image coexist in the fixing nip. In other words, heat is concentratedly applied to the edge surface of the transfer material in the boundary between the portion having a transfer material and a toner image and the portion having no transfer material and no toner image from the fixing film 30 corresponding to the portion having no transfer material and no toner image. Thus, hot offset easily occurs due to excessive heat supply.

In the present embodiment, a toner smear of the transfer material caused by offset has the following characteristics.

(1) A toner smear tends to occur when a total toner amount of respective colors for forming an image transferred to the edge surface of the transfer material is small. It is because the amount of heat applied to toner of a toner image increases to cause an excessive heat supply, generating hot offset.

(2) A color of toner for forming an image transferred to the edge surface of the transfer material changes an apparent toner smear level of the transfer material. On a normally used white transfer material, black toner is most conspicuous, and magenta and cyan are second and third most conspicuous in this order. Yellow toner is not so conspicuous.

In the present embodiment, the reasons are as described above. However, the reason (2) is not limitative. When toner characteristics or image process conditions are different, for example, a smear level of cyan caused by offset may be largest. In such a case, in the image of the present embodiment, the cyan may be determined as an observation color that is an object for increasing a toner amount (toner amount increment) due to a high offset level, and image processing may be carried out to increment, for example, the amount of Y toner relatively lower in visibility. When another toner color low in visibility is set in the image forming apparatus, the amount of toner may be incremented by using the another color low in visibility.

Controller 103

Figure 7:
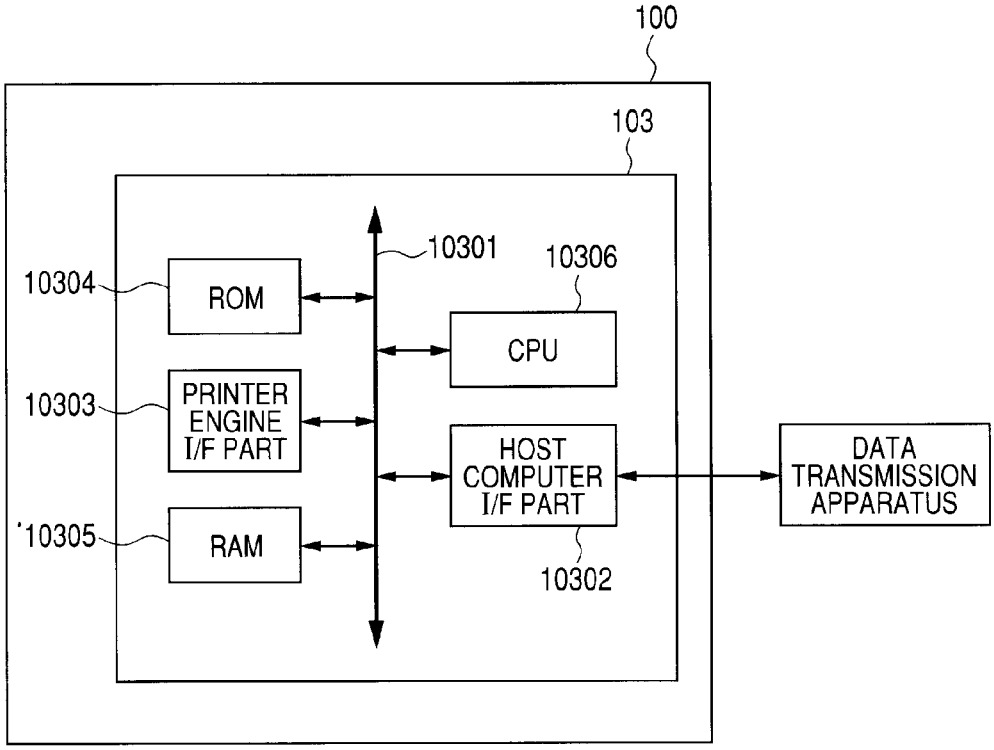
FIG. 7 illustrates a configuration of a controller included in the image forming apparatus according to the first embodiment.

Referring to FIG. 7, the controller 103 described referring to FIG. 1 is described more in detail.

The controller 103 includes devices such as a host computer I/F part 10302, a printer engine I/F part 10303, a ROM 10304, a RAM 10305, and a CPU 10306 which are interconnected via a CPU bus 10301. The CPU bus 10301 includes address, data, and control buses.

The host computer I/F part 10302 has a function of communicating and connecting with a data transmission apparatus such as a personal computer via a network in two ways. The printer engine I/F part 10303 has a function of communicating and connecting with the printer engine control unit 104 in two ways. The controller 103 transmits image information or various instructions to the printer engine control unit 104 via the printer engine I/F part 10303.

The ROM 10304 holds control program codes for executing processing of the present invention (image data processing and toner amount increment processing described later) and other processing. The RAM 10305 is a memory for holding bitmap data of a rendering or color-converting result of image information received by the printer engine I/F part 10303 of the image forming apparatus, a temporary buffer area or various processing statuses. The CPU 10306 controls the devices connected to the CPU bus 10301 based on the control program codes held in the ROM 10304.

Hereinafter, processing of the CPU 10306 is mainly described. However, the configuration of the controller 103 described above is only an example, and thus in no way limitative. For example, an application specific integrated circuit (ASIC) or a system-on-chip (SOC) can be provided in the controller 103 to perform a part or all of the processing of the CPU.

Image Data Processing

Figure 8:
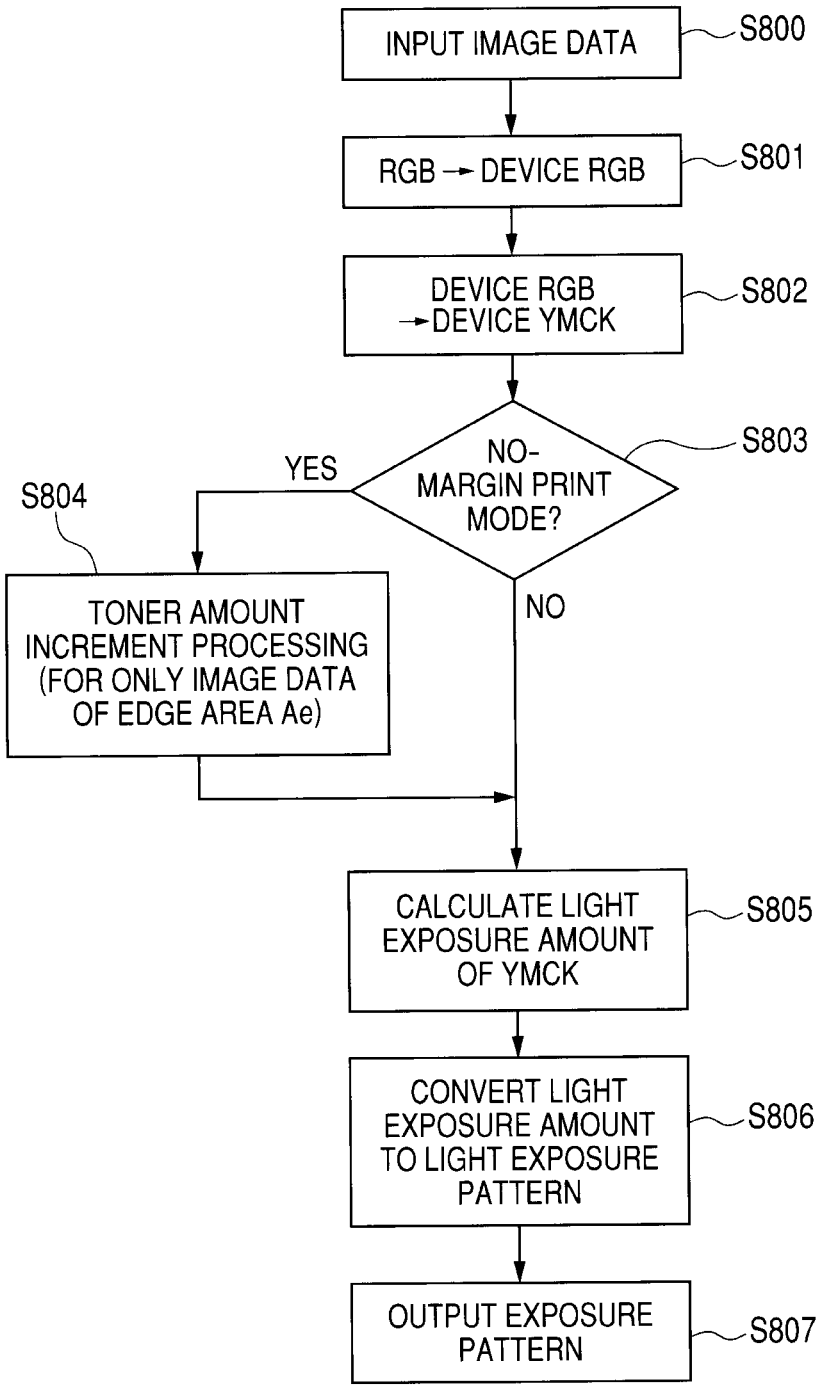
FIG. 8 is a flowchart of image processing performed in the image forming apparatus according to the first embodiment.

Referring to a flowchart of FIG. 8, the image data processing in the image forming apparatus is described. In the processing described below, the CPU 10306 loads the control program stored in the ROM 10304 to the RAM 10305 to execute the control program.

First, in Step S800, image information and various pieces of print setting information such as a paper size and an operation mode, which are transmitted from the personal computer 101 via a network, are received. The image information and various pieces of print setting information may be referred to as print job data. The operation mode includes at least the "margin print mode" and the "no-margin print mode" described referring to FIG. 1.

When the image information regards a color image, a color information format of red, green and blue (RGB) data is employed. In Step S801, color information is respectively allocated to device RGB data reproducible by the apparatus to be converted.

In Step S802, the color information of the image information is converted from the device RGB data into device yellow, magenta, cyan and black (YMCK) data. Each gradation value of the device YMCK data is defined as a ratio (0 to 100%) of a toner amount per unit area transferred to the transfer material when all the lasers of the image forming stations of respective colors are lit. For example, when a laser beam is cast to the photosensitive member according to Y data of 50%, toner of a weight half of that when a laser beam is cast according to data of 100% is transferred to the transfer material as a result.

When it is determined as the margin print mode in Step S803, the process proceeds to Step S805 after Step S802. Before proceeding to Step S805, for the image information, conventionally known image processing may be executed to reduce offset assuming margin print. Alternatively, no image processing assuming offset may be executed.

In Step S805, for the device YMCK data, light exposure amounts of the YMCK colors are calculated by using a gradation table indicating a relationship between light exposure amounts of respective colors and actually used toner amounts.

For each pixel, a light exposure amount (laser beam emission amount) of each color is converted into an actually used light exposure pattern (light emission pattern) (Step S806). The converted light exposure pattern is output (emission-output) (Step S807).

Toner Amount Increment Processing (Step S804)

In the case of the no-margin print mode, as described referring to FIGS. 4A and 4B, an image forming expanded area is disposed for the transfer material P and an image forming operation is carried out. In this case, it is determined as the no-margin print mode in Step S803, Step S804 is executed after Step S802, and then the process proceeds to Step S805.

Figure 9A:
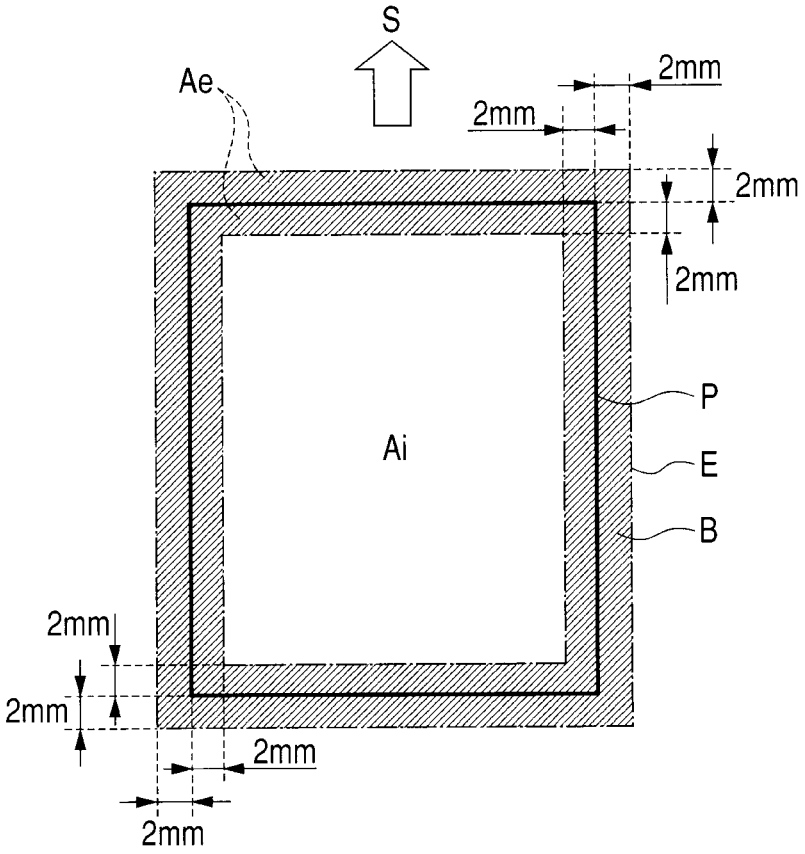
FIGS. 9A and 9B illustrate image processing areas in the image forming apparatus according to the first embodiment.
Figure 9B:
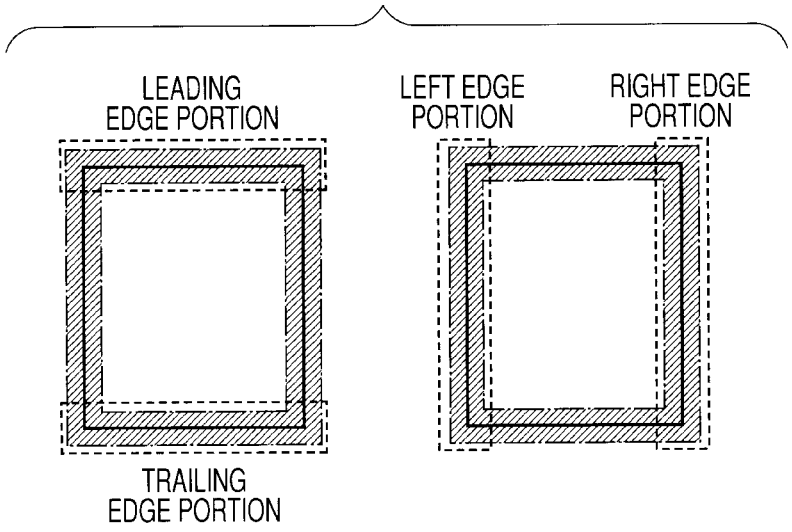

FIGS. 9A and 9B illustrate image processing areas in the image forming apparatus of the first embodiment. A transfer material is conveyed in the transfer material conveying direction S. In the no-margin print mode, as illustrated in FIG. 9A, processing is carried out to increment a toner amount for, in an image formed on the photosensitive drum on the entire surface in the mask area E, image information included in the edge area Ae of the transfer material P. More specifically, the toner amount increment processing is image processing carried out to increment a toner amount of a toner image formed in the image bearing member for the image information of a portion corresponding to the edge area. For an internal area Ai, image processing or measures are taken as in the case of "No" determination in Step S803.

The edge area Ae includes four portions of a leading edge portion, a trailing edge portion, a left edge portion, and a right edge portion. The leading edge portion, the trailing edge portion, the left edge portion, and the right edge portion are as illustrated in FIG. 9B. In FIG. 9A, the edge area is an area in the mask area E from positions 2 mm inside the leading, trailing, left and right edges of the transfer material P to positions 2 mm outside the leading, trailing, left and right edges of the transfer material P (mask area E). The areas 2 mm outside and inside the edges of the transfer material in width constitute an object edge area of the toner amount increment processing. Thus, even when a positional relationship between the image and the transfer material P shifts during the printing operation, the toner amount increment processing is applied on multiple surfaces of the transfer material without failure.

When a width of the object edge area Ae subjected to toner amount increment processing in a direction perpendicular to the edge of the transfer material is twice (or substantially twice) as large as a protruded width of a toner image from the transfer material with no shifting occurrence in positional relationship between the image (toner image) and the transfer material, this status can be efficiently dealt with. In other words, any shifting in positional relationship between the image and the transfer material P can be flexibly dealt with, wasting no toner.

On the other hand, the internal area Ai is another area in the mask area E, in other words, an area from the center of the transfer material P (image) to positions 2 mm inside the leading, trailing, left and right edges.

In the edge area Ae, a summed value of data of respective colors is incremented for the device YMCK data determined in Step S802, and processing of incrementing a toner amount in the edge area Ae is carried out. This processing is not performed in the internal area Ai.

Figure 10:
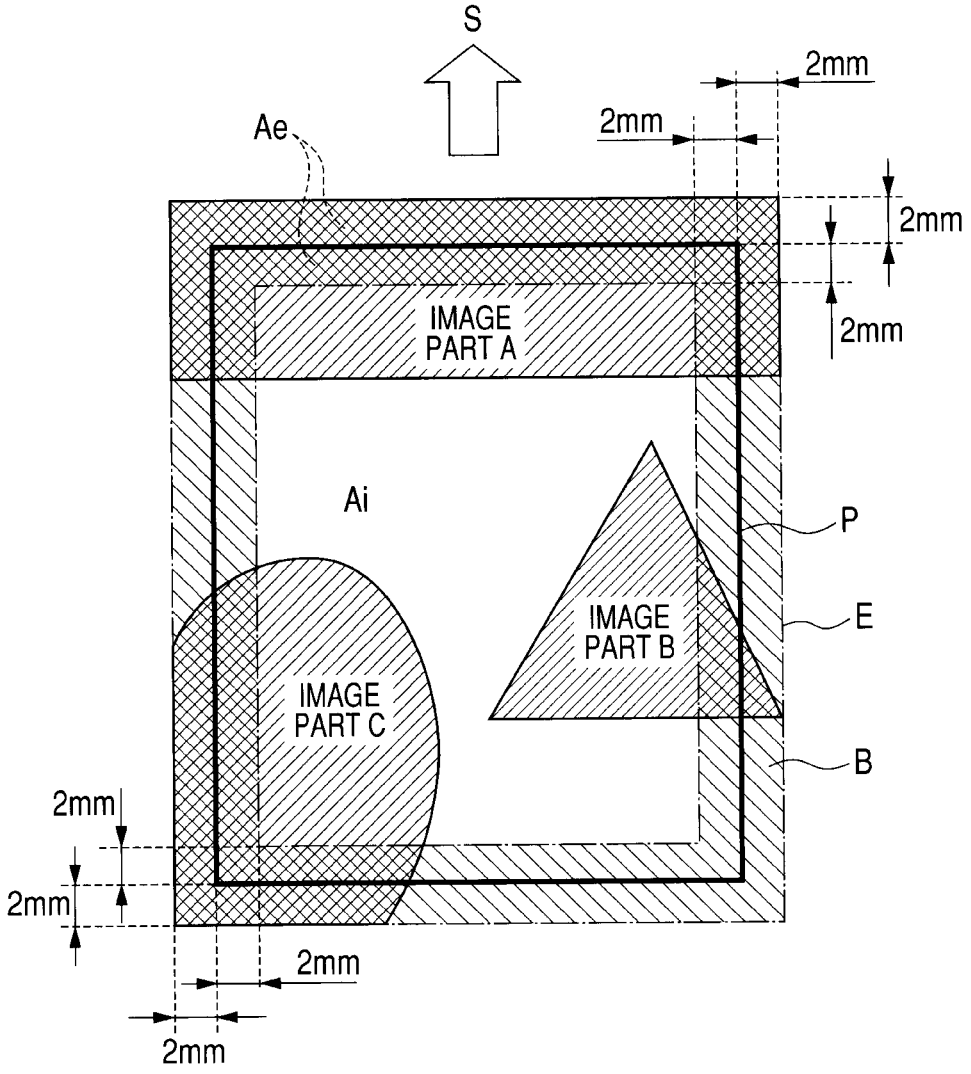
FIG. 10 illustrates a relationship between the image processing area and an image pattern in the image forming apparatus according to the first embodiment.

For example, a case where image formation is carried out by a pattern having image parts A to C such as an image pattern illustrated in FIG. 10, in other words, a pattern having image parts present in both the edge area Ae and the internal area Ai, is described. In FIG. 10, the transfer material is conveyed in the transfer material conveying direction S. This pattern includes image parts not only between the mask area E of FIG. 4A and the mask area E of FIG. 4B but also inside the transfer material. In this case, Step S804 is executed only for image information of pixels included in the edge area Ae among image pixels constituting each image part. Step S804 is not executed for image information of pixels included in the internal area Ai.

Specific Example 1 of Toner Amount Increment Processing

Figure 11A:
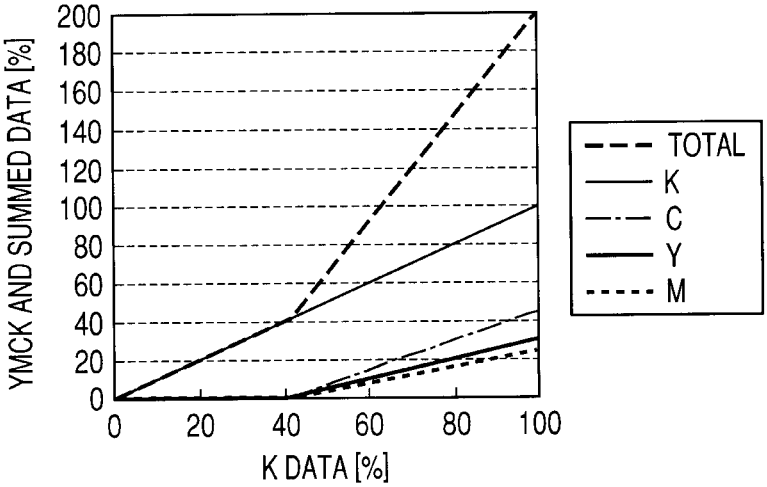
FIGS. 11A, 11B and 11C illustrate color conversion relationships of the image processing performed in the image forming apparatus according to the first embodiment.

As an example of the toner amount increment processing in Step S804, referring to a graph of FIG. 11A, processing for a color belonging to a single K color group in which the device YMCK data determined in Step S802 is Y=M=C=0% and 0<K<100% is described. The device YMCK data is represented in terms of percentage corresponding to the value of a gradation of the device YMCK data. For example, to represent a gradation by 8 bits, FFH is 100%. Hereinafter, a gradation of color data is represented by using "%" unless otherwise specified. This is similar to other embodiments. In actual image formation, cases other than that of Y=M=C=0% and 0<K<100% are possible. However, for K image information, toner amount increment processing illustrated in FIG. 11A may always be carried out.

In the graph of FIG. 11A, the abscissa indicates a gradation of previous K data determined in Step S802, and the ordinate indicates a gradation of the device YMCK data and summed data of respective colors newly determined in Step S804.

When the previous K data is 0 to 40%, the K data is held as it is. When the previous K data is 40 to 100%, in other words, when a gradation of the previous K data exceeds a threshold value, in addition to the previous K data, YMC data of about 0 to 45% of respective colors are added. In this case, summed data of the respective colors is as shown in the graph.

For example, data pieces of respective colors (Y, M, C and K) are each treated as 1-byte data for processing performed in the controller 103. In other words, a data value of 0% is 00hex, a data value of 100% is FFhex, and values therebetween are linearly interpolated in 00hex to FFhex. For example, when previous image data is K data of 80%, the data is treated as CChex. For the data determined in Step S804, based on the relationship of FIG. 11A, Y data is 33hex (20%), M data is 2Bhex (17%), C data is 4Chex (30%), and K data is CChex (80%).

Even in the case of a color belonging to the single K color group, when an image of a color in which K data has a gradation of about 40 to 100% is present in the edge surface of the transfer material, hot offset easily occurs (in the gradation of about 0 to 40% of K data, a toner amount is small, and even if offset occurs, it is not conspicuous because of a small offset toner amount). A toner color is black, and hence a toner smear of the transfer material when offset occurs is likely to be conspicuous.

When the edge area of the K data thus input is about 40 to 100%, adding YMC data corresponding to the edge area, and incrementing summed data of the respective colors to perform printing enable suppression of occurrence of toner smears of the transfer material P caused by offset at any gradations.

This is because a total amount of toner for forming an image on the edge surface of the transfer material is incremented to suppress occurrence of hot offset, and offset can be prevented from being conspicuous even if the offset occurs by using mixed toner of YMC relatively lower in visibility on the transfer material P than K toner as toner to be incremented.

In this processing, YMC toner that becomes a process black color when mixed with the black color is only added. Thus, chromaticity changes are suppressed to lower values for an image color before processing.

Figure 11B:
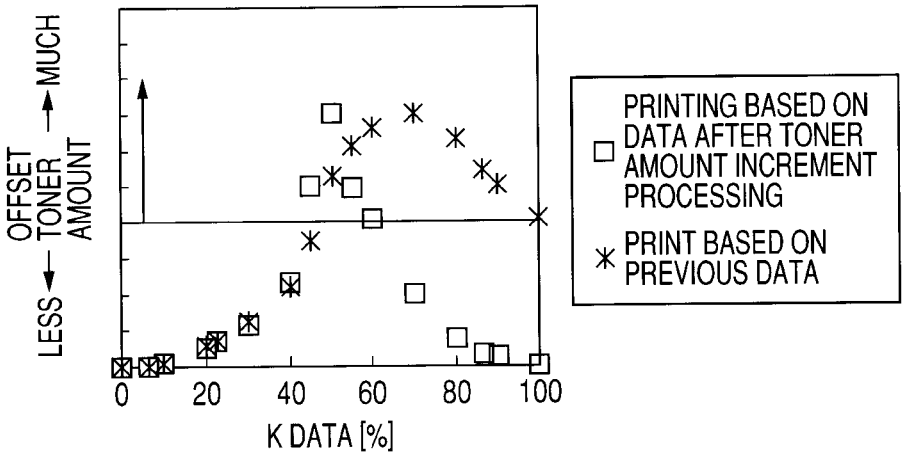
Figure 11C:
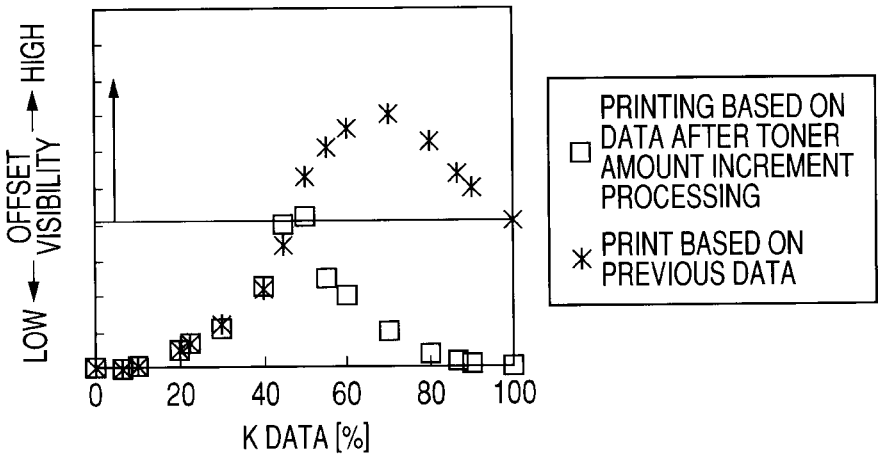

Referring to FIG. 11B, a suppression effect of an offset toner amount provided by improvement in fixing performance provided in the toner amount increment processing is described. Referring to FIG. 11C, a suppression effect of offset visibility provided by decrease in fixing performance due to the toner amount increment processing is described. As described above, in FIGS. 11A to 11C, the device YMCK data is assumed to be Y=M=C=0% and 0<K<100%.

In the graph of FIG. 11B, the abscissa indicates a gradation of K data, and the ordinate indicates an offset toner amount.

FIG. 11B illustrates at which gradation of the K data a peak of an offset toner amount comes when printing is executed based on K data contained in previous image information before the toner amount increment processing and when printing is executed based on image information containing K data after the toner amount increment processing.

In the case of printing based on the previous K data, the offset toner amount is larger at a gradation of 50% to 100% (gradation width of Δ50%) of the K data. The offset toner amount is largest when a gradation of the K data is 70%. In the case of a single K color, the occurrence of hot offset is most conspicuous at a toner amount when a gradation of the K data before the toner amount increment processing is 70%.

In the case of printing based on K data after toner amount increment processing, an offset toner amount is larger at a 45% to 60% gradation (gradation width Δ15%) of the previous K data. An offset toner amount is largest when a gradation of the previous K data is 50%. A summed data amount (total toner amount) of the respective colors in this case is roughly equal to that when the occurrence of hot offset is most conspicuous before toner amount increment processing.

In other words, the toner amount increment processing shifts a gradation of the K data to a low side at the time of a total toner amount when an offset toner amount is largest (from 70% to 50%). Thus, a ratio of the K data to all toner amounts is small based on a toner amount of a color of low visibility, and hot offset occurs in a smaller status of the K data ratio to all the toner amounts. In other words, a hot offset amount of K of highest visibility is reduced. It can be understood from FIG. 11B that a width of a gradation at which an offset toner amount is larger is reduced (from Δ50% to Δ15%) and that the occurrence of hot offset is suppressed at all the gradations.

In the graph of FIG. 11C, an abscissa indicates the same as that of FIG. 11B, and an ordinate indicates an offset visibility level. FIG. 11C illustrates comparison of offset visibility levels between when printing is executed based on previous K data and when printing is executed based on K data after toner amount increment processing. For the visibility level, various known image evaluation methods can be employed, and parameters of an ordinate vary from one method to another. Detailed description thereof is omitted.

In the case of printing based on the previous K data, offset visibility levels are higher at gradations of 50% to 100% of the K data corresponding to the offset toner amount. An offset visibility level is highest at a gradation of 70% of the K data.

In the case of printing based on the K data after the toner amount increment processing, offset visibility levels are higher at gradations of 45% to 60% of the previous K data corresponding to the offset toner amount. An offset visibility level is highest at a gradation of 50% of the previous K data. However, a ratio of the K data to all is small when offset is large, and hence a visibility level is suppressed more as compared with the case of the printing based on the previous K data. This is because toner incremented by the toner amount increment processing is YMC toner.

Specific Example 2 of Toner Amount Increment Processing

Figure 12:
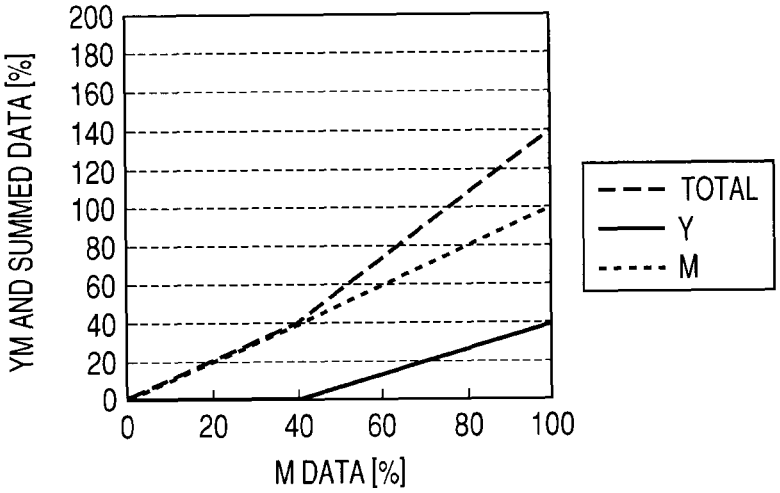
FIG. 12 illustrates another color conversion relationship of the image processing performed in the image forming apparatus according to the first embodiment.

As another example, referring to a graph of FIG. 12, processing for a color belonging to a single M color group in which the device YMCK data determined in Step S802 is Y=C=K=0% and 0≤M≤100% is described. In FIG. 12, executing toner amount increment processing based on Y of relatively low visibility for an observation color M conspicuous when hot offset occurs provides the same suppression effect of an offset toner amount as that of FIGS. 11A to 11C. Detailed description thereof is omitted.

In the graph of FIG. 12, an abscissa indicates a gradation of previous M data determined in Step S802, and an ordinate indicates a gradation of YM data and summed data of colors which are newly determined in Step S804.

When previous M data is 0 to 40%, the M data is maintained as it is. When the previous M data is 40 to 100%, in other words, when a gradation of the previous M data exceeds a threshold value, in addition to the previous M data, Y data of about 0 to 40% is added. In this case, summed data of the colors is as shown in the graph.

Even in the case of a color belonging to the single M color group, when an image of a color M of a gradation of 40 to 100% is present on the edge surface of the transfer material, hot offset easily occurs (in the gradation of 0 to 40% of M data, a toner amount is small, and even if offset occurs, the offset is not conspicuous because of a small offset toner amount). The toner color is magenta, and hence a toner smear of the transfer material when offset occurs is conspicuous though not as much as black.

Even for image information of a color belonging to such a single color group, adding Y data in the edge area, and incrementing summed data of the respective colors to perform printing enable suppression of generation of toner smears of the transfer material P caused by offset at any gradations.

This is because a total amount of toner for forming an image on the edge surface of the transfer material is incremented to suppress occurrence of hot offset, and because offset can be prevented from being conspicuous even if the offset occurs by using Y toner relatively lower in visibility on the transfer material P than M toner as toner to be incremented.

This processing only adds Y toner relatively small in chromaticity changes even when the Y toner is mixed with magenta to the magenta color. Thus, chromaticity changes are limited low for an image color before processing.

Specific Example 3 of Toner Amount Increment Processing

Figure 13:
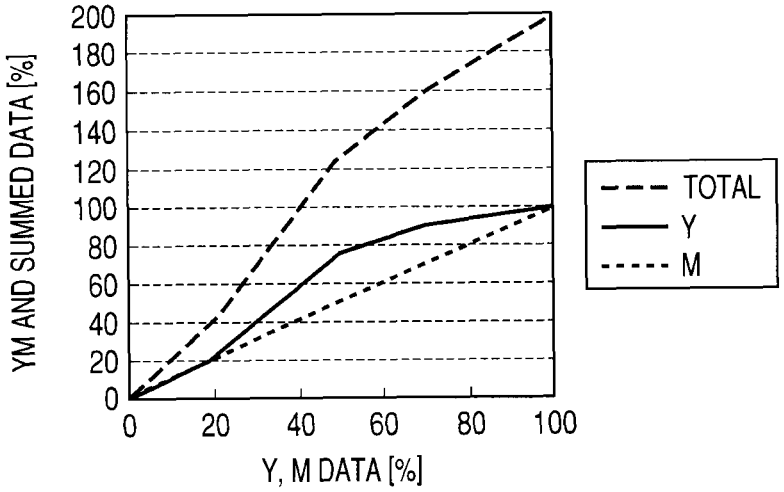
FIG. 13 illustrates still another color conversion relationship of the image processing performed in the image forming apparatus according to the first embodiment.

As still another example, referring to a graph of FIG. 13, processing for a color belonging to a secondary Red color group in which the device YMCK data determined in Step S802 is C=K=0% and 0≤Y=M≤100% is described. In FIG. 13, executing toner amount increment processing based on Y of relatively low visibility for an observation color M also provides the same suppression effect for an offset toner amount as that of FIGS. 11A to 11C. Detailed description thereof is omitted.

In the graph of FIG. 13, an abscissa indicates a gradation of previous Y data and previous M data determined in Step S802, and an ordinate indicates a gradation of YM data and summed data of colors which are newly determined in Step S804. When each of previous Y data and previous M data is 0 to 20%, the Y data and the M data are maintained as they are. When each of the previous Y data and the previous M data is 20 to 100%, in other words, when a gradation of the previous Y data and the previous M data exceeds a threshold value, Y data of about 0 to 25% is added while the previous M data is maintained as it is. In this case, summed data of the colors is as shown in the graph.

Even in the case of a color belonging to the secondary Red color group, when an image of a color of a gradation in which the Y and M data are 20% or more is present on the edge surface of the transfer material, hot offset easily occurs (in the gradation of 0 to 20% of Y and M data, a toner amount is small, and even if offset occurs, the offset is not conspicuous because of a small offset toner amount). The toner color contains magenta toner, and hence a toner smear of the transfer material when offset occurs is also conspicuous.

Even for an image of such a color, adding Y data corresponding to the edge area, and incrementing summed data of the respective colors to perform printing enable suppression of generation of toner smears of the transfer material P caused by offset at any gradations. This is because a total amount of toner for forming a toner image on the edge surface of the transfer material is incremented to suppress occurrence of hot offset, and because offset can be prevented from being conspicuous even if the offset occurs by using Y toner relatively lower in visibility on the transfer material P than M toner as toner to be incremented.

This processing only adds Y toner relatively low in chromaticity changes to a Red color even when a mixing amount in the Red color is incremented. Thus, chromaticity changes are limited low for an image color before processing.

Comparison Test

FIG. 14 illustrates a result of comparing print image levels between when toner amount increment Step S804 is executed and when not executed during image formation carried out in the no-margin print mode in the image forming apparatus of the first embodiment. As an image pattern, a pattern having images of representative colors #1 to #9 of the single K color group, the single M color group, and the secondary Red color group which are arranged in the edge area Ae of the transfer material P is used.

Test No. 1 is based on the configuration of the present embodiment. Toner amount increment Step S804 was executed for the previous image information determined in Step S802, and a total toner amount of respective colors was incremented in the edge area to perform no-margin print.

In this case, a good print image having no toner smear of a transfer material caused by offset was obtained on the transfer material P. A reduction in image quality caused by a chromaticity difference between the area Ae and the area Ai feared due to Step S804 was suppressed to a level of almost no problem.

Test No. 2 is based on a configuration of a comparative example. The test shows a result of executing no-margin print without executing toner amount increment Step S804. In this case, in colors #1 to #9, it was confirmed that offset of an image disposed on the edge surface of the transfer material caused a toner smear or a slight toner smear of the transfer material.

As described above, in the electrophotographic image forming apparatus of the present embodiment that can perform no-margin print, fixing performance during the no-margin print can be improved.

When similar images are formed in the edge area and the internal area during the no-margin print operation, printing is carried out by incrementing the toner amount of the image disposed in the edge area of the transfer material more than that of the image disposed in the internal area. Thus, a print image can be obtained, in which a toner smear of the transfer material caused by offset of the image transferred to the edge surface of the transfer material in the fixing device is suppressed well.

In the toner amount increment processing, a toner amount of a color relatively lower in visibility as compared with an observation color conspicuous when offset occurs is incremented. Thus, chromaticity changes accompanying the toner amount increment processing can be suppressed small. As a result, a reduction in image quality caused by a difference in color reproducibility between the edge area and the internal area is suppressed, and a good print image can be obtained in the entire area of the transfer material.

Second Embodiment

Figure 15A:
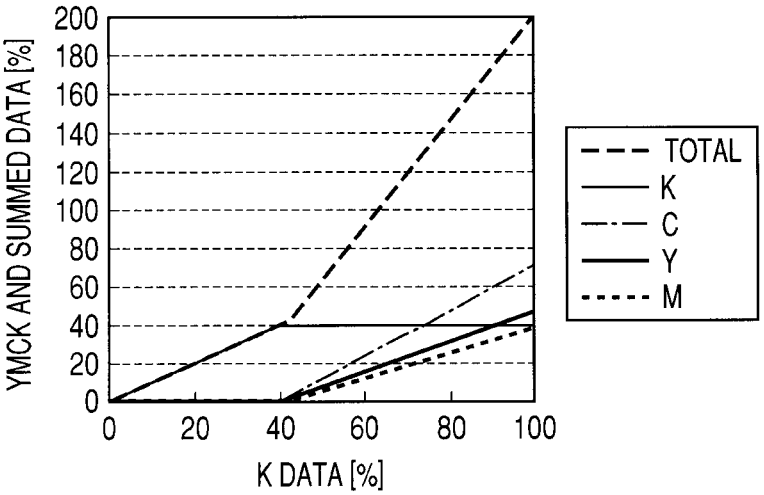
FIGS. 15A and 15B illustrate color conversion relationships of image processing performed in an image forming apparatus according to a second embodiment.
Figure 15B:
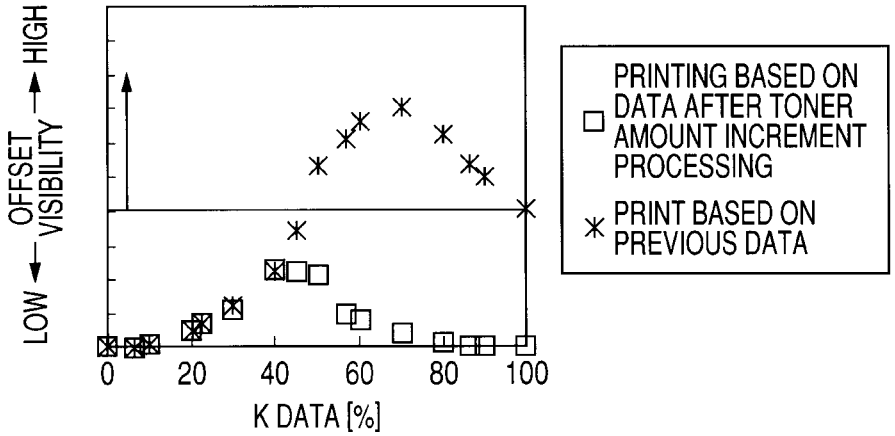
Figure 16:
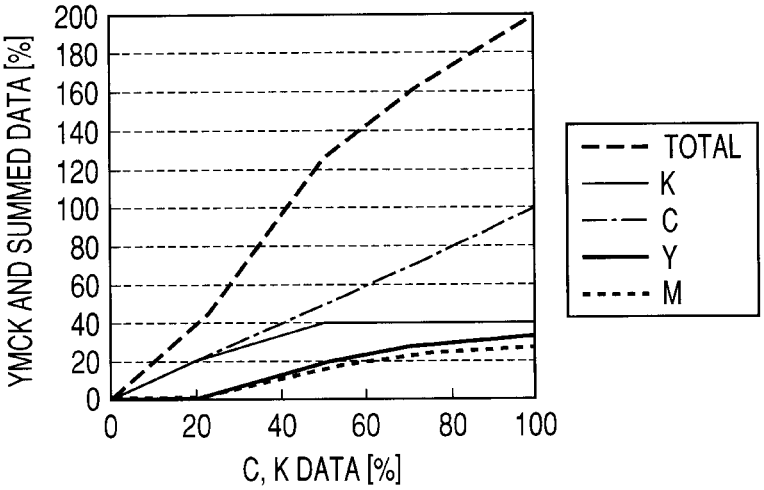
FIG. 16 illustrates another color conversion relationship of the image processing performed in the image forming apparatus according to the second embodiment.

An image forming apparatus of the second embodiment is similar to the image forming apparatus of the first embodiment except for a color conversion relationship of Step S804 illustrated in FIGS. 15A and 15B and FIG. 16.

The image forming apparatus of the present embodiment includes an image forming section of four colors of yellow (Y), magenta (M), cyan (C), and black (K), a transfer device that includes an intermediate transfer belt as an intermediate transfer member, and a fixing device.

As described above, in the first embodiment, the toner amount increment processing for the image disposed in the edge area of the transfer material enables good suppression of a toner smear of the transfer material during the no-margin print. However, to suppress a toner smear of the transfer material well even in a case of no-margin print performed on not only plain paper but also such types of transfer materials as coat paper, glossy paper and a glossy film, an offset level should desirably be improved more. Such a transfer material has high surface smoothness. Thus, offset toner transferred to a fixing film or a pressure roller easily attaches again to a surface of the transfer material, the toner is crushed on the transfer material to easily expand its area, and even a small amount of offset toner is conspicuous.

A configuration to achieve the object of the present invention is described below.

Specific Example 4 of Toner Amount Increment Processing

As an example of toner amount increment processing in Step S804 of the present embodiment, referring to a graph of FIG. 15A, processing for a color belonging to a single K color group in which YMCK data determined in Step S802 is Y=M=C=0% and 0≤K≤100% is described.

In the graph of FIG. 15A, an abscissa indicates a gradation of previous K data determined in Step S802, and an ordinate indicates a gradation of YMCK data and summed data of colors which are newly determined in Step S804.

When a gradation of the previous K data is 0 to 40%, the gradation of the K data is maintained as it is. When a gradation of the previous K data is 40 to 100%, in other words, when a gradation of the previous K data exceeds a threshold value, the gradation of the K data is suppressed to 40% as a fixed value, and YMC data of colors of 0 to 72% are added. A gradation of summed data of the respective colors in this case is as indicated by a broken line of the graph. In the graph of FIG. 15A, offset is prevented from being conspicuous by replacing toner of a color relatively low in visibility with toner of an observation color in which offset exceeding a threshold value easily occurs. This is similar for FIG. 16.

Even in the case of a color belonging to the single K color group, when an image of K data of a gradation of 40 to 100% is present on the edge surface of the transfer material, hot offset easily occurs (in the gradation of 0 to 40% of K data, a toner amount is small, and even if offset occurs, the offset is not conspicuous because of a small offset toner amount). The toner color is black, and hence a toner smear of the transfer material when offset occurs is easily conspicuous.

Thus, in the case of the K data of a gradation of 40 to 100%, the gradation of the K data is reduced, YMC data is added instead, and summed data of the respective colors is incremented to perform printing. As a result, at any gradations, the occurrence of a toner smear of the transfer material P caused by offset can be greatly suppressed.

This is because a total amount of toner for forming an image on the edge surface of the transfer material is incremented to suppress hot offset, a ratio of K toner of high visibility on the transfer material P is reduced, and offset is prevented from being conspicuous even if the offset occurs by using YMC toner relatively low in visibility instead. This processing only adds, to the black color, YMC toner that becomes a process black color when mixed. Thus, chromaticity changes for an image color before processing are suppressed to a minimum.

A suppression effect of an offset toner amount provided by the toner amount increment processing is basically similar to that described above referring to FIGS. 11A to 11C. However, in the case of FIG. 15A, when a gradation of the K data is set equal to or more than a threshold value, toner amount increment processing is carried out by replacing toner of a color (CMY mixed color) relatively low in visibility with toner of an observation color (K). Thus, when the K data takes a gradation equal to or more than the threshold value, a toner amount corresponding to the K data is smaller than that of FIGS. 11A to 11C, and hence an image formed object having offset improved more can be obtained. FIG. 15B illustrates its result.

In the graph of FIG. 15B, an abscissa indicates a gradation of the K data, and an ordinate indicates an offset visibility level. An image evaluation method, an ordinate, and what should be indicated by the ordinate are similar to those of FIGS. 11A to 11C. In FIG. 15B, offset visibility levels are compared with each other between when printing is executed based on K data before toner amount increment processing and when printing is executed based on K data after toner amount increment processing.

In the case of printing based on the previous K data, corresponding to an offset toner amount, an offset visibility level is higher at a gradation of 50% to 100% of the K data. An offset visibility level is highest when a gradation of the K data is 70%.

In the case of printing based on K data after toner amount increment processing, corresponding to the offset toner amount, an offset visibility level is higher at a gradation of 45% to 60% of the previous K data. An offset visibility level is highest when a gradation of the previous K data is 50%. A visibility level is suppressed more as compared with the case of the printing based on the previous K data. A suppression effect of the present embodiment is greater than that of the first embodiment illustrated in FIG. 11C. This is because the toner amount increment processing not only increments YMC toner but also reduces K toner.

Specific Example 5 of Toner Amount Increment Processing

As another example, referring to a graph of FIG. 16, processing for a color belonging to a mixed color group of C and K (bluish black) in which the YMCK data determined in Step S802 is Y=M=0% and 0=C=K=100% is described. In FIG. 16, executing toner amount increment processing based on CMY mixed color of relatively low visibility for an observation color K conspicuous also provides the same suppression effect of an offset toner amount as that of FIGS. 15A and 15B. Detailed description thereof is omitted.

In the graph of FIG. 16, an abscissa indicates a gradation of previous C and K data determined in Step S802, and an ordinate indicates a gradation of YMCK data and summed data of colors which are newly determined in Step S804.

When the previous C and K data are 0 to 20%, the C and K data are maintained as they are. When the previous C and K data are 20 to 100%, in other words, when gradations of the previous C and K data exceed threshold values, the K data is suppressed to 40% or less while the C data is maintained as it is, and YM data of colors of about 0 to 33% are added. Summed data of the respective colors is as indicated by a broken line of the graph.

Even in the case of a color belonging to the mixed color group of C and K, when an image of a color of a gradation of 20% or more of C and K data is present on the edge surface of the transfer material, hot offset easily occurs (in the gradation of 0 to 20% of C and K data, a toner amount is small, and even if offset occurs, the offset is not conspicuous because of a small offset toner amount). The toner color contains black toner, and hence a toner smear of the transfer material when offset occurs is also easily conspicuous.

Even for such a color, the K data is reduced in the edge area, YM data are added, and a gradation value of summed data of respective colors is incremented to perform printing, whereby the occurrence of a toner smear of the transfer material P caused by offset can be suppressed at any gradations. This is because a total amount of toner for forming an image on the edge surface of the transfer material is incremented to suppress the occurrence of hot offset, K toner of high visibility on the transfer material P is reduced, and offset can be prevented from being conspicuous if the offset occurs by using YM toner relatively low in visibility instead. This processing only adds, to a mixed color group of C and K, YM toner relatively small in chromaticity changes when mixed. Thus, chromaticity changes for an image color before processing are suppressed small.

As described above, in the electrophotographic image forming apparatus of the present embodiment that can perform no-margin print, fixing performance during the no-margin print can be improved. As illustrated in FIGS. 15A and 15B and FIG. 16, a ratio of black that is an observation color when offset occurs can be set lower than that of the first embodiment, and hence offset can be prevented from being conspicuous more greatly.

Thus, even in a case of no-margin print executed by using not only plain paper but also such transfer materials of high surface smoothness as coat paper, glossy paper, and a glossy film, a print image can be obtained in which a toner smear of the transfer material caused by offset of an image transferred to the edge surface of the transfer material in the fixing device is suppressed.

In the second embodiment, as illustrated in FIGS. 15A and 15B and FIG. 16, a toner consumption amount is larger than that of the first embodiment. Thus, the first embodiment may be implemented in the case of plain paper or a printing mode corresponding to plain paper. The second embodiment may be implemented in the case where a transfer material of high surface smoothness such as coat paper, glossy paper, or a glossy film is used or in a case of a printing mode corresponding thereto. This way, an offset status can be efficiently improved, a toner consumption amount can be reduced more, and usability can be improved more.

Third Embodiment

Figure 17:
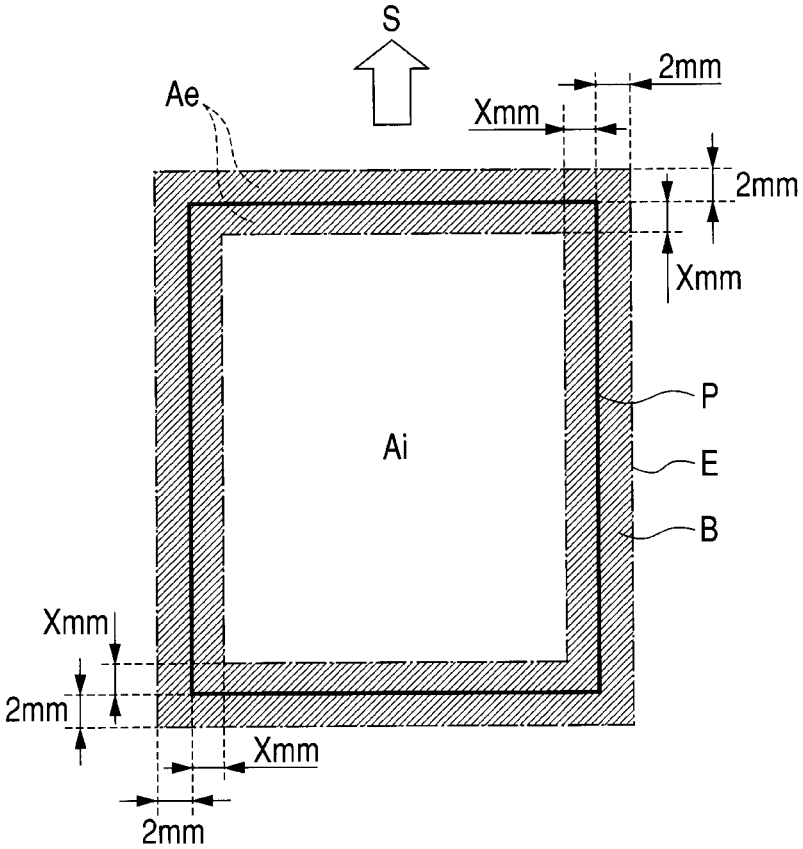
FIG. 17 illustrates an image processing area in an image forming apparatus according to a third embodiment.

An apparatus of a third embodiment is similar to that of the first embodiment except for an arranging relationship between an edge area Ae and an internal area Ai illustrated in FIG. 17.

The image forming apparatus of the present embodiment includes image forming sections of four colors such as yellow (Y), magenta (M), cyan (C), and black (K), a transfer device that includes an intermediate transfer belt as an intermediate transfer member, and a fixing device.

According to the first and second embodiments, the toner amount increment processing for the image set in the edge area of the transfer material enables good suppression of a toner smear of the transfer material during the no-margin print. However, if a positional relationship greatly shifts between the image on the intermediate transfer belt and the transfer material P during the printing operation, the image part whose toner amount has been incremented may not be set in the edge surface of the transfer material P, and hence an offset suppression effect may not be obtained. Consequently, a toner smear may occur in the transfer material.

To solve the above-mentioned problem, a width of the edge area may be set sufficiently large so that the image part whose toner amount has been incremented can be surely set in the edge surface of the transfer material P even if the positional relationship greatly shifts. However, with the large width of the edge area, even a slight color difference between the image of the edge area and the image of the internal area can be visible, causing a reduction in image quality.

To solve the above-mentioned problem, an area for performing the toner amount increment processing in the transfer material has to be appropriately set. Hereinafter, a configuration to achieve the object is described by using the image forming apparatus of the present embodiment that can arbitrarily change the processing area.

In the image forming apparatus of the present embodiment, as illustrated in FIG. 17, the edge area Ae for performing the toner amount increment processing covers an area in a mask area E from positions X[mm] inside leading, trailing, left and right edge of the transfer material P to positions 2 mm outside the leading, trailing, left and right edge of the transfer material P (mask area E). A value of X (protruded width of the transfer material inside) is arbitrarily set to 0 to 10 mm. The internal area Ai covers the other area in the mask area E, in other words, an area from the center of the transfer material P to positions X mm inside the leading, trailing, left and right edge thereof.

To check changes in image level based on the X value, comparison test of print image levels based on setting of X values was carried out. FIG. 18 illustrates its results. For an image pattern, image parts having such representative colors as the single K color group, the single M color group and the secondary Red group of the first embodiment were arranged in the edge area Ae of the transfer material P.

In the case of 0 mm<x<1 mm, visibility of a slight color difference of images between the areas Ae and Ai was maintained to a low value because of a small area of the area Ae. When a positional relationship shifted between the image and the transfer material P during a printing operation, offset caused a toner smear of the transfer material. It was due to an image part that was not set in the edge surface of the transfer material P even though a toner amount was incremented for an image in the area Ae, disabling obtaining of a hot offset suppression effect.

In the case of 1 mm<x<3 mm, visibility of a slight color difference of images between the areas Ae and Ai was still maintained to a low value because of a small area of the area Ae. Even when a positional relationship shifted between the image and the transfer material P during the printing operation, no toner smear occurred in the transfer material by offset.

In the case of 3 mm<x<5 mm, an area of the area Ae was slightly increased, enabling visual recognition of a slight color difference of images between the areas Ae and Ai. However, no great reduction occurred in image quality. Even when a positional relationship shifted between the image and the transfer material P during the printing operation, no toner smear occurred in the transfer material by offset.

In the case of X>5 mm, an area of the area Ae was further increased, increasing visibility of a color difference of images between the areas Ae and Ai. Reduction accordingly occurred in image quality. In other words, even when the pattern illustrated in FIG. 10 was printed as an image pattern, an area of the image part included in the area Ae was increased, facilitating visual recognition of a color difference from the image part included in the internal area Ai. On the other hand, when a positional relationship shifted between the image and the transfer material P during the printing operation, no toner smear occurred in the transfer material by offset.

In the third embodiment (and the first and second embodiments), a width of an image forming expanded area B is 2 mm as illustrated in FIGS. 4A and 4B. The width is set to assure formation of a no-margin print image on the transfer material P even when shifting in positional relationship between the image on the intermediate transfer belt and the transfer material P is largest in the image forming apparatus. Setting of the width of the image forming expanded area to a necessary and sufficient value enables suppression of an increase in toner consumption accompanying no-margin print.

Similar setting of the X value to 2 mm assures suppression of offset in addition to the above-mentioned suppression even when shifting in positional relationship between the image on the intermediate transfer belt and the transfer material P is largest.

As described above, it was found from the result of examination using the image forming apparatus of the present embodiment that the area for performing the toner amount increment processing for the image is desirably set as an area from positions 1 mm to 5 mm inside the edges of the transfer material to positions outside the transfer material. Thus, even when the positional relationship shifts between the image and the transfer material P during the printing operation, the image part whose toner amount has been incremented is surely set in the edge surface of the transfer material P, and a toner smear of the transfer material caused by offset is accordingly suppressed greatly. Visibility of a color difference between the images set in the edge area and the internal area of the transfer material is always maintained to a low value, suppressing a reduction in image quality.

Fourth Embodiment

In each of the above-mentioned embodiments, the area for performing the toner amount increment processing covers all the leading, trailing, left and right edge portions (FIG. 9B) constituting the edge area of the transfer material P. However, according to characteristics of the image forming apparatus, a portion to be processed can be limited to a portion where offset easily occurs.

For example, there is provided an image forming apparatus configured such that a pre-rotation operation of a fixing device is started simultaneously with starting of an image forming operation, and waste heat is accumulated in a fixing film or a pressure roller of the fixing device before a transfer material reaches a fixing nip. In such an image forming apparatus, offset occurs more easily in a leading edge portion of the transfer material P than in trailing, left and right edge portions. When the leading edge portion of the transfer material P enters the fixing device to start a fixing process, the waste heat is gradually removed from the fixing device. Thus, offset is relatively difficult to occur in the trailing, left and right edge portions of the transfer material P. In this image forming apparatus, the toner amount increment processing has to be performed only for the leading edge portion. The toner amount increment processing may be performed for toner images corresponding to not only the leading edge portion but also at least one of the leading, trailing, right and left edge portions where offset easily occurs.

The image forming apparatus described in each of the embodiments uses a "film fixing method" employing a fixing film as the fixing device. For the fixing film, for example, a film member having a diameter of 24 mm formed by coating a surface of a polyimide resin having a thickness of 50 μm with a fluororesin having a thickness of 10 μm is used. A ceramic heater is disposed in the fixing film, and the fixing film abuts an opposingly disposed pressure roller at pressure of about 200 to 400 N. For the pressure roller, for example, a roller member having a diameter of 25 mm formed by depositing a silicon rubber layer having a thickness of 3 mm on an outer periphery of a core metal and coating its surface with a fluororesin layer having a thickness of 15 μm is used.

There has been developed an image forming apparatus that includes a fixing device of a "roller fixing method" employing a fixing roller in place of a fixing film. For the fixing roller, for example, a roller member formed by depositing a silicon rubber layer having a thickness of 2 mm on a core metal of an iron having an outer diameter of 46 mm and a thickness of 2 mm, and coating its surface with a fluororesin having a thickness of 20 μm is used. A halogen heater is disposed in the fixing roller, and the fixing roller abuts an opposingly disposed pressure roller at pressure of about 500 to 800 N. The same roller member as that of the above is used for the pressure roller.

Generally, the fixing device of the "film fixing method" is characterized by its capability of performing an on-demand fixing operation by short-time temperature rising, and the fixing device of the "roller fixing method" is characterized by its capability of obtaining high glossiness on a print image sample by the high abutment pressure.

Needless to say, the toner amount increment processing described above is useful in an image forming apparatus that includes fixing devices of various methods including the above-mentioned two methods. However, this processing is more advantageous in an image forming apparatus that includes a fixing device of the "film fixing method". The reason is as follows.

In the fixing device of the "roller fixing method", as described above, abutment pressure is higher in the fixing nip than that in the fixing device of the "film fixing method". Accordingly, in addition to offset (hot offset) caused by a thermal factor described above in the first embodiment of the present invention, offset (mechanical offset) caused by a pressure factor occurs. The offset caused by the pressure factor is a phenomenon in which, due to application of high pressure in the fixing nip, a part of toner on the transfer material does not stay on the surface of the transfer material but is physically separated from the transfer material to move onto the fixing roller. On the other hand, in the fixing device of the "film fixing method", abutment pressure is low, and offset mainly occurs due to a thermal factor. Thus, the toner amount increment processing of the present invention provides a higher effect.

Fifth Embodiment

In each of the embodiments, the image forming apparatus 100 performs the toner amount increment processing. However, this arrangement is in no way limitative. A host computer 101 connected to the image forming apparatus may perform the toner amount increment processing of the image forming apparatus 100. In this way, the configuration of the image forming apparatus 100 can be further simplified, enabling cost reduction.

More specifically, the host computer 101 includes a printer driver that converts image data generated by an arbitrary application into image information to be interpreted by the image forming apparatus 100. The printer driver generates image information of YMCK subjected to the toner amount increment processing in Step S804 by using the image data generated by the arbitrary application as input image data in Step S800.

The printer driver compresses data of the generated image information, and outputs the compressed data to a port of the host computer 101 whose destination has been set to the image forming apparatus in advance. The host computer 101 transmits the compressed data output to the port according to the port setting to the image forming apparatus 100.

A controller 103 receives the compressed image data transmitted from the host computer 101, decompresses the data, and outputs the decompressed data of image information to a printer engine side or a printer engine control unit 104. The printer engine side refers to the printer engine control unit 104 and the printer engine described referring to FIG. 2.

According to the fifth embodiment, performing image processing as the toner amount increment processing by the host computer 101 enables simplification of the configuration of the image forming apparatus 100. As a result, even when an image is formed by the cost-reduced image forming apparatus, effects similar to those of the first to fourth embodiments can be obtained.

Sixth Embodiment

In each of the embodiments, the toner amount increment processing is carried out by incrementing a toner amount of a color (e.g., CMY mixed color) relatively lower in visibility compared to an observation color image (e.g., K image information) of the toner amount increment.

However, in the electrophotographic image forming apparatus capable of performing no-margin print, the above-mentioned arrangement is in no way limitative for improving fixing performance during no-margin print. In the edge area, for example, for a K color, the toner amount increment processing may be carried out by using the same K color. In this case, in the edge area, chromaticity changes are slightly larger than those in the first to fifth embodiments. However, this arrangement can prevent a total toner amount in a portion where offset easily occurs from being incremented, providing an effect of improving fixing performance.

Other Embodiments

Various embodiments have been described in detail. However, the present invention may be applied to a system that includes multiple devices or an apparatus that includes one device. For example, the present invention may be applied to a computer system that includes a printer, a facsimile, a PC, a server and a client.

The present invention can be achieved by supplying software programs for realizing the functions of the embodiments described above to the system or the apparatus directly or from a remote place, and reading the supplied program codes by a computer included in the system to execute the programs.

Thus, the program codes stored in the computer to realize the functions and processing of the present invention by the computer realize the present invention. In other words, the computer programs to realize the functions and processing are also one of the components of the present invention.

In this case, as long as program functions are provided, any types of programs such as object codes, programs executed by an interpreter, and script data supplied to the OS can be employed.

Examples of recording media for supplying programs are a flexible disk, a hard disk, an optical disk, a magneto-optical disk, an MO, a CD-ROM, a CD-R, and a CD-RW. Other recording media may be a magnetic tape, a nonvolatile memory card, a ROM, and a DVD (DVD-ROM or DVD-R).

The program may be downloaded from a home page of the Internet by using a browser of a client computer. In other words, the computer program of the present invention or a compressed file including an automatic installation function may be downloaded from the home page onto a recording medium such as a hard disk. The functions can be realized by dividing program codes of the program of the present invention into multiple files and downloading the files from different home pages. In other words, a WWW server that enables multiple users to download program files for realizing the functions and processing of the present invention by the computer is also a component of the present invention.

The programs of the present invention may be encrypted to be stored on a recording medium such as a CD-ROM, and distributed to the users. In this case, only users who satisfy predetermined conditions may be permitted to download key information for decrypting the programs from a home page via the Internet, and decrypt the encrypted programs by the key information to execute the programs, thereby installing the programs in the computers.

The computer may execute the read programs to realize the functions of the embodiments described above. Based on instructions of the programs, the OS operating on the computer may carry out a part or all of actual processing. Needless to say, in this case, the functions of the embodiments described above can be realized.

The programs read from the recording medium may be written in a memory disposed in a function expansion board inserted into the computer or a function expansion unit connected to the computer. Based on instructions of the programs, a CPU disposed in the function expansion board or the function expansion unit may carry out a part or all of actual processing. Thus, the functions of the embodiments described above can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-206071, filed Aug. 8, 2008, which is hereby incorporated by reference herein in its entirety.

The invention claimed is:

1. An image forming apparatus, comprising:

an image forming section configured to form a no-margin image on a transfer material based on image data by:

forming, on an image bearing member, a toner image having an edge area with an inside width which is inward relative to edges of the transfer material and an outside width which is outward relative to the edges of the transfer material, transferring the toner image formed on the image bearing member to the transfer material, and fixing the toner image onto the transfer material by heating the toner image transferred onto the transfer material; and a processing section configured to perform toner amount increment processing for further increasing toner amount of the toner image formed in the edge area to be more than toner amount of the toner image formed in the edge area based on the image data when the no-margin image is formed, wherein the image forming section is further configured to form the portion of the toner image within the edge area in accordance with the toner amount increment processing by the processing section.

2. An image forming apparatus according to claim 1, wherein the toner image is formed based on image information, and wherein the processing section performs, as the toner amount increment processing for the portion of the image information corresponding to the edge area, image processing for incrementing the toner amount in the toner image formed on the image bearing member.

3. An image forming apparatus according to claim 1, wherein the toner amount increment processing is performed when color data corresponding to the image information exceeds a threshold value.

4. An image forming apparatus according to claim 1, wherein the toner image is formed based on image information, and wherein, in the toner amount increment processing for image information having a high gradation value, the toner image is formed by using a toner amount which is greater than a toner amount used in the toner amount increment processing for image information having a low gradation value.

5. An image forming apparatus according to claim 1, wherein the edge area consists of an outer area of the transfer material and an area outside of the transfer material, and a width of the edge area in a direction perpendicular to a width direction between edges of the transfer material is equal to a sum of a width of the outer area of the transfer material and a width of the area outside of the transfer material, and the width of the edge area in the direction perpendicular to the width direction between edges of the transfer material is equal to twice or substantially twice as large as the width of the outer area of the transfer material.

6. An image forming apparatus according to claim 1, wherein the edge area includes an outer area of the transfer material and an area outside of the transfer material, wherein a width of the outer area of the transfer material is greater than or equal to 1 millimeter and less than or equal to 5 mm.

7. An image forming apparatus according to claim 1, wherein the edge area comprises:

a leading edge portion that includes a leading edge of the transfer material;

a trailing edge portion that includes a trailing edge of the transfer material;

a right edge portion that includes a right edge of the transfer material; and a left edge portion that includes a left edge of the transfer material, wherein the toner amount increment processing is performed for the portion of the toner image that includes at least one of: the leading edge portion, the trailing edge portion, the right edge portion, and the left edge portion.

8. A method of generating image information for forming a no-margin image based on image data, comprising the steps of:

generating image information for forming, on an image bearing member, a toner image having an edge area with an inside width which is inward relative to edges of a transfer material and an outside width which is outward relative to the edges of the transfer material; and performing toner amount increment processing for further increasing toner amount of the toner image formed in the edge area to be more than toner amount of the toner image formed in the edge area on the image data when the no-margin image is formed.

9. A non-transitory computer readable storage medium storing a computer program for causing a computer to execute a method of generating image information for forming a no-margin image based on image data, the method comprising the steps of:

generating image information for forming, on an image bearing member, a toner image having an edge area with an inside width which is inward relative to edges of a transfer material and an outside width which is outward relative to the edges of the transfer material; and performing toner amount increment processing for further increasing toner amount of the toner image formed in the edge area to be more than toner amount of the toner image formed in the edge area based on the image data when the no-margin image is formed.

10. An image forming apparatus according to claim 2, wherein the edge area comprises:

a leading edge portion that includes a leading edge of the transfer material;

a trailing edge portion that includes a trailing edge of the transfer material;

a right edge portion that includes a right edge of the transfer material; and a left edge portion that includes a left edge of the transfer material, wherein the toner amount increment processing is performed for the portion of the toner image that includes at least one of: the leading edge portion, the trailing edge portion, the right edge portion, and the left edge portion.

11. An image forming apparatus according to claim 3, wherein the edge area comprises:

a leading edge portion that includes a leading edge of the transfer material;

a trailing edge portion that includes a trailing edge of the transfer material;

a right edge portion that includes a right edge of the transfer material; and a left edge portion that includes a left edge of the transfer material, wherein the toner amount increment processing is performed for the portion of the toner image that includes at least one of: the leading edge portion, the trailing edge portion, the right edge portion, and the left edge portion.

12. An image forming apparatus according to claim 4, wherein the edge area comprises:

a leading edge portion that includes a leading edge of the transfer material;

a trailing edge portion that includes a trailing edge of the transfer material;

a right edge portion that includes a right edge of the transfer material; and a left edge portion that includes a left edge of the transfer material, wherein the toner amount increment processing is performed for the portion of the toner image that includes at least one of: the leading edge portion, the trailing edge portion, the right edge portion, and the left edge portion.

13. An image forming apparatus according to claim 5, wherein the edge area comprises:

a leading edge portion that includes a leading edge of the transfer material;

a trailing edge portion that includes a trailing edge of the transfer material;

a right edge portion that includes a right edge of the transfer material; and a left edge portion that includes a left edge of the transfer material, wherein the toner amount increment processing is performed for the portion of the toner image that includes at least one of: the leading edge portion, the trailing edge portion, the right edge portion, and the left edge portion.

14. An image forming apparatus according to claim 6, wherein the edge area comprises:

a leading edge portion that includes a leading edge of the transfer material;

a trailing edge portion that includes a trailing edge of the transfer material;

a right edge portion that includes a right edge of the transfer material; and a left edge portion that includes a left edge of the transfer material, wherein the toner amount increment processing is performed for the portion of the toner image that includes at least one of: the leading edge portion, the trailing edge portion, the right edge portion, and the left edge portion.

15. An image forming apparatus, comprising:

an image forming section configured to form a no-margin image on a transfer material by:

forming, on an image bearing member, a toner image having an edge area with an inside width which is inward relative to edges of the transfer material and an outside width which is outward relative to the edges of the transfer material, transferring the toner image formed on the image bearing member to the transfer material, and fixing the toner image onto the transfer material by heating the toner image transferred onto the transfer material; and a processing section configured to perform toner amount increment processing for increasing a toner amount for a portion of the toner image formed within the edge area when the no-margin image is formed, wherein the image forming section is further configured to form the portion of the toner image within the edge area in accordance with the toner amount increment processing by the processing section, wherein the toner amount increment processing is performed by incrementing a toner amount of a color relatively lower in visibility compared to an observation color that is an object of the toner amount increment processing.

16. An image forming apparatus according to claim 15, wherein the observation color is one of black and magenta, and wherein the color relatively lower in visibility is one of yellow and a mixed color of yellow, magenta, and cyan.

17. An image forming apparatus according to claim 15, wherein a ratio of a toner amount of the observation color to a total toner amount when an image failure occurs is based on the toner amount of the color having a relatively lower visibility.

18. An image forming apparatus according to claim 15, wherein in the toner amount increment processing, the toner amount of the color having a relatively lower visibility is increased by replacing toner of the color having the relatively lower visibility with toner of the observation color exceeding a threshold value.

19. An image forming apparatus according to claim 15, wherein the edge area comprises:

a leading edge portion that includes a leading edge of the transfer material;

a trailing edge portion that includes a trailing edge of the transfer material;

a right edge portion that includes a right edge of the transfer material; and a left edge portion that includes a left edge of the transfer material, wherein the toner amount increment processing is performed for the portion of the toner image that includes at least one of: the leading edge portion, the trailing edge portion, the right edge portion, and the left edge portion.

* * * * *